US006905034B2

(12) United States Patent
Jones

(10) Patent No.: US 6,905,034 B2
(45) Date of Patent: Jun. 14, 2005

(54) CLIP TRAY AND METHOD OF RETAINING AND INDIVIDUALLY RELEASING CYLINDRICAL SHAPED OBJECTS

(75) Inventor: Wayne H. Jones, Idaho Falls, ID (US)

(73) Assignee: New Phase, Inc., Idaho Falls, ID (US)

( * ) Notice: Subject to any disclaimer, the term of this patent is extended or adjusted under 35 U.S.C. 154(b) by 81 days.

(21) Appl. No.: 10/376,752

(22) Filed: Feb. 28, 2003

(65) Prior Publication Data

US 2004/0168996 A1 Sep. 2, 2004

(51) Int. Cl.[7] ..... A47G 29/00
(52) U.S. Cl. ..... 211/85.18
(58) Field of Search ..... 211/85.18, 88.01, 211/70.3, 71.01

(56) References Cited

U.S. PATENT DOCUMENTS

| | | | | |
|---|---|---|---|---|
| 768,007 A | * | 8/1904 | Weissenstein | 131/239 |
| 2,212,129 A | | 8/1940 | Rust | |
| D178,029 S | * | 6/1956 | Warren | D7/501 |
| 3,270,877 A | | 9/1966 | Hecker | |
| 4,072,235 A | * | 2/1978 | Bermudez Munoz | 211/71.01 |
| 4,182,455 A | * | 1/1980 | Zurawin | 211/85.18 |
| D283,076 S | | 3/1986 | States, Jr. | |
| 4,962,860 A | | 10/1990 | Lehmann | |
| 4,984,693 A | | 1/1991 | Belokin, Jr. et al. | |
| 5,090,577 A | | 2/1992 | Lehmann | |
| 5,318,190 A | * | 6/1994 | Mason | 211/41.2 |
| 5,333,745 A | | 8/1994 | Lehmann | |
| 6,279,760 B1 | * | 8/2001 | Broeski | 211/71.01 |
| D468,591 S | | 1/2003 | Lillelund et al. | |

FOREIGN PATENT DOCUMENTS

| | | |
|---|---|---|
| CH | 281928 | 3/1952 |
| FR | 1312481 | 12/1962 |
| FR | 2825254 | 12/2002 |

* cited by examiner

*Primary Examiner*—Peter M. Cuomo
*Assistant Examiner*—Sarah Purol
(74) *Attorney, Agent, or Firm*—John R. Ley

(57) ABSTRACT

A disk-like container having a cylindrical sidewall is retained and released from a receptacle formed by a partial cylindrical back wall adapted to contact the cylindrical sidewall of the container. A first portion of the back wall extends circumferentially less than 180 degrees around the cylindrical sidewall of the container. A second portion of the back wall extends from the first portion, and cumulatively with the first portion extends circumferentially to greater than 180 degrees around the cylindrical sidewall of the container. A release tab formed by the second portion of the back wall deflects to move the second portion outward away from the cylindrical sidewall of the container to permit the container to be inserted into and removed from the receptacle. A plurality of the receptacles are formed in a single clip tray, and the clip trays may be oriented and positioned singularly or in multiple assemblies.

75 Claims, 12 Drawing Sheets

CLIP TRAY AND METHOD OF RETAINING AND INDIVIDUALLY RELEASING CYLINDRICAL SHAPED OBJECTS

This invention generally relates to apparatus and methods for organizing, retaining, displaying, dispensing, accessing and individually releasing cylindrical shaped objects, such as disk-like cylindrical shaped containers. More particularly, the present invention relates to a new and improved clip tray and method for retaining and individually releasing cylindrical shaped objects in a manner which allows the objects to be presented and organized for convenient access on a readily-apparent basis and released from the order in which they are presented on a convenient and individual basis.

BACKGROUND OF THE INVENTION

Relatively small disk-like cylindrical shaped containers have been used for many purposes. Food, candy, and chewing gum have been packaged in such containers, which are generally formed from clear and opaque plastic. Chewing tobacco has also been packaged in such containers made of both plastic and metal. Other types of non-foodstuff consumer products have also been marketed in such containers. Clear plastic disk-like cylindrical containers have been made available to users in an empty condition, to allow the users to fill them with different types of relatively small objects that the user wishes to segregate and organize for convenience and specific-use purposes. For example, screws, nuts and bolts of particular sizes are segregated into separate containers according to the size and other distinguishing characteristics of the items. Small items used in hobbies, such as photograph holder corners, lettering, glitters, and powders used in scrap book construction, may be placed into separate containers according to the type and size of the item. Buttons, fasteners, and needles used in sewing may also be separately contained in individual containers. Flies and lures for fishing, as well as many other relatively small sporting goods items, may be kept separately in such containers. In general, such disk-like cylindrical containers may be used to separate a wide variety of relatively small items.

Although the disk-like cylindrical containers are useful for segregating various items, a further difficulty arises in organizing the containers in such a way that the individual containers may be readily recognized and accessed. From the standpoint of dispensing or selling products, it is desirable to present the consumer with all of the available choices of different types of products that are marketed in such containers, so that the user can conveniently select the desired product. While the products can be stacked on top of one another, such stacks and other orientations do not facilitate a continuous orderly display of the products. Such stacks usually become disarrayed or scattered as a result of consumers sorting through the stacks to locate the desired item.

One typical type of point of purchase display used with disk-like cylindrical containers is a tube rack, which is a tube shaped structure which confines the cylindrical containers within its interior, in a stacked relationship. The containers are loaded into the top of the tube. Only the bottom container within the tube can be removed, because the only access to the tube is through a removal opening located at one end of the tube. The containers move downward in the tube rack toward the removal opening from the force of gravity as the bottom containers in the tube are removed. The tube rack may be made of clear plastic to reveal the nature of each type of container. If a consumer desires a container located in the middle of the stack, the containers must be removed one at a time from the bottom of the stack in the tube rack until the desired container is finally reached. Those containers removed to obtain access to the desired container should be replaced into the tube rack, but consumers frequently do not do so. If the containers are replaced, the replacement is frequently haphazard and in such a way that the containers could jam together within the center of the tube rack and prevent the further downward movement of the containers to the removal opening.

Other types of point of purchase dispensers for disk-like cylindrical containers are made of wire and shaped as a vertically oriented rectangular rack. These rectangular wire racks function in a manner similar to tube racks, in that the containers are stacked within the interior of the wire rack, are removed from a bottom access opening in the wire rack and move downward from the force of gravity. The openings between the individual wires of the wire rack permit the user to see the individual containers in the wire rack. Unlike a tube rack, the openings between the wires permit manipulation of the containers within the center of the stack to remedy jam problems caused by disorientation of the containers.

Another type of point of purchase dispenser which is similar to both a rectangular wire rack and a tube rack is made of heavy paper or cardboard material. Such heavy paper or cardboard material racks are configured as a rectangular box structure having a bottom access opening, similar to the configuration of a rectangular rack. Because of the opaque heavy paper or cardboard, the contents of the stack are not visible to the consumer. Only the last or bottom one of the containers is visible through at the access opening.

A further type of dispenser for disk-like cylindrical containers is a track or shoot-like structure in which the containers are confined in a serial fashion. Instead of a vertical stack of containers, the track locates the containers in a side-by-side, generally horizontal-oriented line. The track is at a slight vertical declining slope, so that gravity moves the containers downward in a line toward a bottom dispensing opening. Removing the bottom container in the line causes the other containers in the track to move downward within the track. However, like the tube, wire and rectangular box racks, the track structure still requires the cylindrical containers to be dispensed or moved one at a time in a serial fashion until the desired container is reached.

The track structure is frequently inefficient from a space utilization standpoint, because a relatively large horizontal surface area is required to support the track. Furthermore, if separate tracks are vertically stacked with respect to one another, viewing the individual containers along the length of each track is impossible. To obtain better space utilization, the tracks are sometimes formed in curved configurations, but those curved configurations are still not space-efficient.

In those circumstances where there are only a few different products displayed for sale, a separate track, tube rack, wire rack or rectangular box rack may be used for each different product. However, this requires a number of different dispensers, and a relatively large amount of space is consumed by those dispensers.

Cylindrical shaped dispensers have also been devised to present the individual cylindrical containers in a side-by-side manner. An access slot is formed in the side of the cylindrical shaped dispenser by which to remove a selected one of the containers from the row. The access slot has a width which extends circumferentially around the cylindrical shaped dispenser for less than 180 degrees. The remaining portion of the cylindrical dispenser occupies more than 180 degrees of contact with the cylindrical container, and thereby holds the cylindrical container within the dispenser. To remove the cylindrical container, the container must be grasped and pulled out of the dispenser. In doing so, the part of the cylindrical dispenser which contacts more than 180 degrees of the cylindrical container must be bent or deflected outward. The bending frequently has the unintended effect of releasing the non-selected containers which are adjacent to the selected container. To prevent the unintended removal of non-selected containers, the consumer is required to hold in the adjacent containers with one hand while attempting to remove the selected container with the other hand. Alternatively, a consumer will simply allow the non-selected containers to come out of the dispenser and then not replace the non-selected containers.

An alternative form of a cylindrical dispenser requires the selected container to be twisted sideways within the cylindrical dispenser until its parallel sidewalls are parallel to the axis of the cylindrical dispenser. Oriented in this manner, the cylindrical container can be removed through the access slot. However, to provide the necessary space for the cylindrical container to be twisted, the space within the cylindrical dispenser cannot be fully occupied by the containers. Consequentially, the cylindrical dispenser cannot be fully loaded or occupied with the cylindrical containers. Moreover, if the cylindrical dispenser is not fully loaded with the containers, those containers within the dispenser have the opportunity to twist and fall sideways which can cause disorientation and jams of the containers within the dispenser. Such random movement also creates a possibility for the containers to fall from the dispenser.

The organizational issues associated with point of purchase dispensers are similar to issues arising from the personal use of the disk-like cylindrical containers. For purposes of convenience, the user, like the consumer, needs to view all of the containers in order to select the desired one without disrupting the organization of the non-selected containers. However, in personal use circumstances, it is usually necessary to present and organize a large number of containers which hold different items, in contrast to a point of purchase situation where there may be a lesser number of items but more duplicates of the same item. Thus, from the personal use standpoint, the containers should be collected, presented and organized to allow the user to quickly locate and release the desired container from among a relatively large number of such containers.

SUMMARY OF THE INVENTION

The present invention relates to a clip tray and a method of organizing, retaining and releasing disk-like cylindrical shaped containers in such a way that each individual container is readily presented, organized and released on an individual basis for use or consumption, without the necessity to remove or reorient all or a significant number of the other containers, and without disturbing or disrupting the organization and presentation of the other containers. The clip tray and the methodology of the present invention are used equally beneficially as point of purchase dispensers for consumer items as well as organizers for personal use items. The clip tray and the methodology of the present invention also present the opportunity to assemble and organize a collection of related use items for specific purposes, such as kits used for specific purposes. Further still, the clip tray and methodology of the present invention achieve a high level of space utilization and volumetric consumption to provide these and other advantages and efficiencies with respect to a large number of cylindrical containers.

In accordance with these and other aspects, the clip tray of the present invention retains and releases a disk-like cylindrical container having a cylindrical sidewall and two generally planar end walls. The clip tray comprises a structure defining fixed contacts adapted to contact and adjoin the cylindrical sidewall of the container at positions spaced circumferentially less than 180 degrees around the cylindrical sidewall of the container. A divider is adapted to contact one of the generally planar end walls of the container. A release tab defines a movable contact adapted to contact and adjoin the cylindrical sidewall of the container at a position which, cumulatively with the contacts at positions less than 180 degrees, extends the circumferential contact with the cylindrical sidewall to greater than 180 degrees around the cylindrical sidewall of the container when the release tab is in a first position. The greater than 180 degrees of contact retains the container. The release tab is moveable to a second position in which the movable contact is separated from the cylindrical sidewall in which circumstance only the fixed contacts contact the cylindrical sidewall at less than 180 degrees of circumference of the cylindrical sidewall to release the container.

The preferable form of the fixed and movable contacts is established by a partial cylindrical back wall adapted to contact and adjoin the cylindrical sidewall of the container. The back wall has a first portion which extends circumferentially less than 180 degrees around the cylindrical sidewall of the container. The back wall also has a second portion which extends from the first portion. The first and second portions of the back wall cumulatively extend circumferentially to greater than 180 degrees around the cylindrical sidewall of the container. The release tab is formed by the second portion of the back wall. The release tab is deflectable to move the second portion to the second position radially outward away from the cylindrical sidewall of the container so only the first portion of the back wall is in contact with the cylindrical sidewall of the container to permit the insertion and release of the cylindrical container. While the release tab is in contact with the cylindrical sidewall, the container is retained.

Other preferable aspects of the clip tray include integrally extending the release tab second portion of the back wall from the first portion so the second portion can be resiliently deflected relative to the first portion. Dividers preferably extend substantially along the full circumferential extent of the first portion of the back wall. An opening is preferably formed through the first portion of the back wall through which to apply force when removing the container or through which light may pass to illuminate the containers and their contents. A receptacle is defined by the first portion of the back wall and the divider within which to receive each container, and preferably a plurality of receptacles form each clip tray. A slot is preferably formed into the back wall on each opposite side of the second portion of the back wall, and the slots define each release tab. The first and second portions of the back walls of the plurality of receptacles are preferably formed by a common partial cylindrical back wall. A release arm is preferably connected to the release tab to move into contact with the cylindrical container and urged the cylindrical container out of the receptacle.

The clip tray may be positioned and oriented using attachment brackets which connect to end walls of the clip tray, with each end wall having a predetermined configuration to fit within a correspondingly shaped opening in the attachment tray. The clip tray may also include a retention tab connected to an axially extending edge and having an opening for receiving a fastener. The clip tray may also be positioned and oriented by attaching the common partial cylindrical back wall to a support, such as with fasteners extending through attachment holes in the common partial cylindrical back wall, with double back tape connected to the back side of the back wall, or with a conventional hook and loop fastener. A plurality of the clip trays may be organized into a carousel configuration, preferably with each clip tray extending vertically.

In accordance with the above described and other aspects, the method of the present invention relates to retaining a disk-like cylindrical container within a receptacle and releasing the cylindrical container from the receptacle. The cylindrical container has a cylindrical sidewall. The method comprises contacting the cylindrical sidewall with fixed contacts at positions spaced circumferentially less than 180 degrees around the cylindrical sidewall, contacting the cylindrical sidewall with a movable contact adapted to contact the cylindrical sidewall at a position which cumulatively with the fixed contacts extends the circumferential contact to greater than 180 degrees when the movable contact is in a first position and to less than 180 degrees when the movable contact is in a second position. The fixed contacts moved to the second position to release the cylindrical container from the receptacle and to the first position to retain the cylindrical container in the receptacle.

This methodology is preferably implemented by contacting the cylindrical sidewall of the container with a partial cylindrical back wall of the receptacle, locating the fixed contacts on a first portion of the back wall circumferentially less than 180 degrees around the cylindrical sidewall of the container, and locating the movable contact on a second portion of the back wall which when accumulated with the first portion extends the circumferential contact to greater than 180 degrees around the cylindrical sidewall.

Other preferable aspects of the method include resiliently deflecting the second portion of the back wall relative to the first portion of the back wall, applying pressure to the cylindrical container through an access opening formed in the first portion of the back wall to remove the cylindrical container from the receptacle, and applying the pressure through the access opening while simultaneously resiliently deflecting the second portion of the back wall. Other preferable aspects include guiding the cylindrical container along dividers which define each receptacle to insert the container into each receptacle and to remove the container from each receptacle. In addition, the method may include urging the cylindrical container out of the receptacle upon deflecting the second portion of the back wall outward, such as by contacting the cylindrical sidewall of the cylindrical container with a contact element connected to the second portion of the back wall to apply force to the cylindrical sidewall to urge the cylindrical container out of the receptacle.

A more complete appreciation of the scope of the present invention and the manner in which it achieves the above-noted and other improvements can be obtained by reference to the following detailed description of presently preferred embodiments taken in connection with the accompanying drawings, which are briefly summarized below, and by reference to the appended claims.

BRIEF DESCRIPTION OF THE DRAWINGS

FIG. 1 also illustrates in exploded perspective relationship, a perspective view of a disk-like cylindrical container which embodies a typical type of cylindrical shaped object with which the clip tray is typically used.

DETAILED DESCRIPTION

Figure 1:
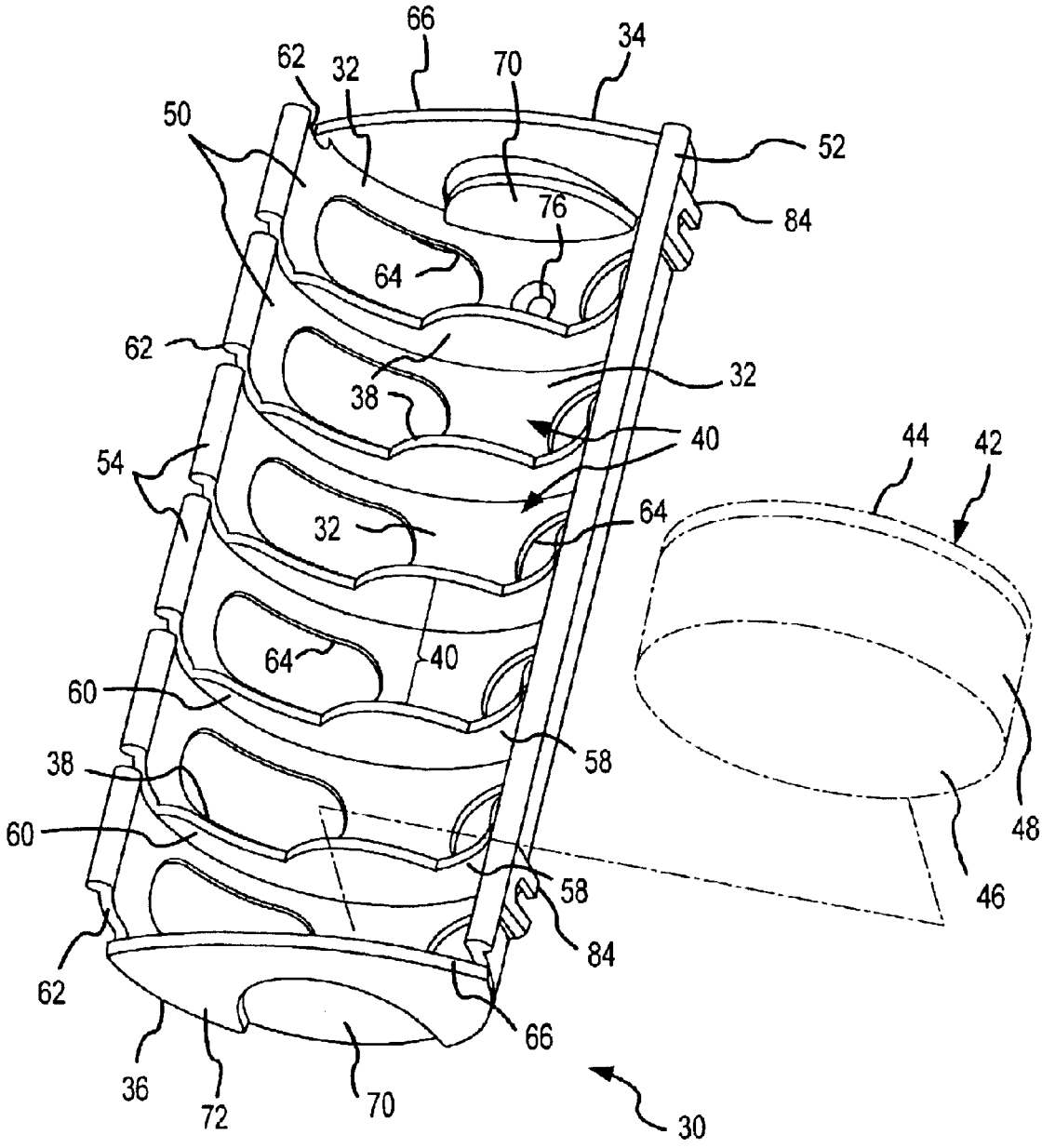
FIG. 1 is a front perspective view of a clip tray for organizing, retaining, displaying, dispensing and accessing cylindrical shaped objects, which embodies the present invention.
Figure 2:
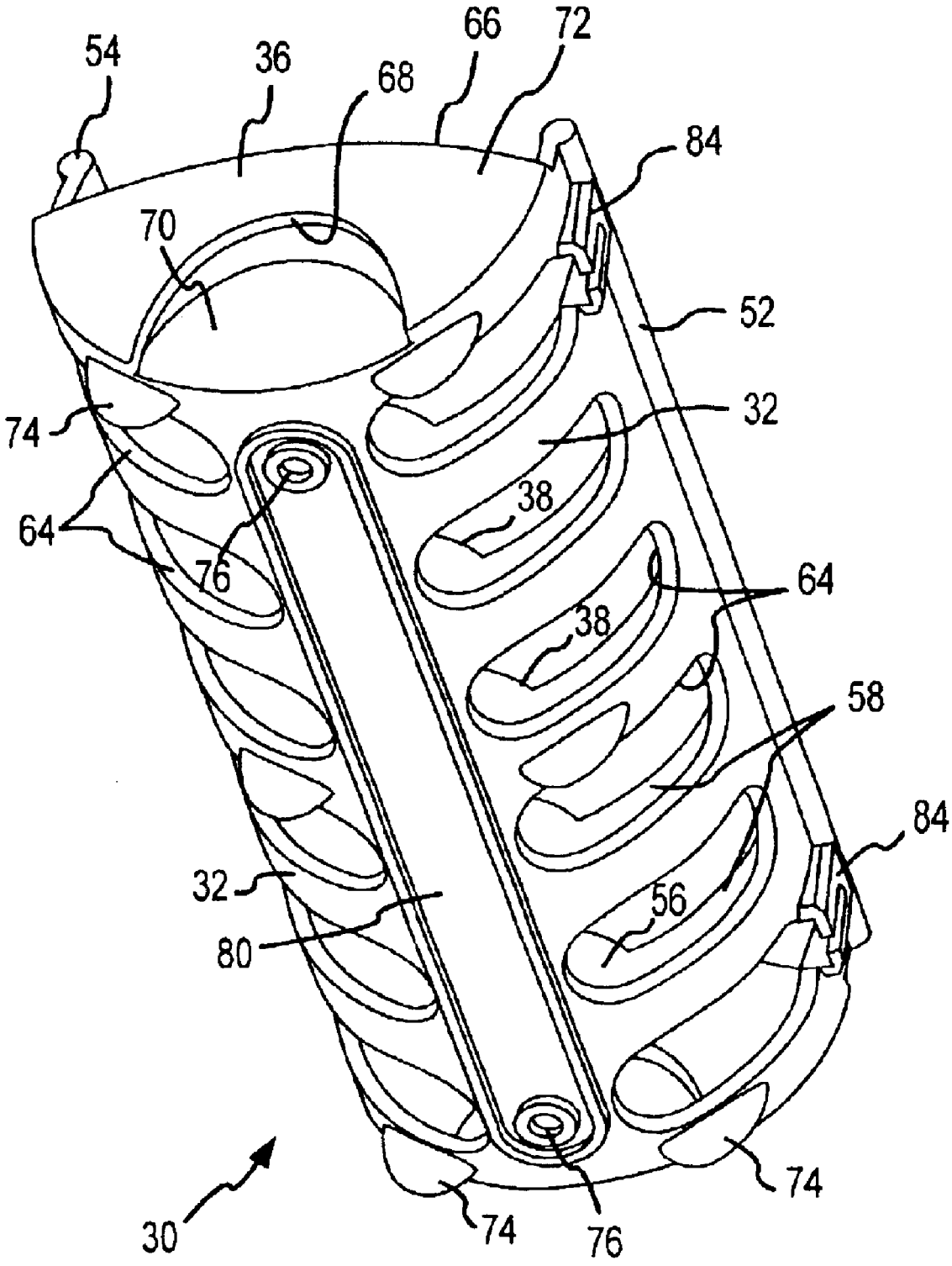
FIG. 2 is a rear perspective view of the clip tray shown in FIG. 1.
Figure 3:
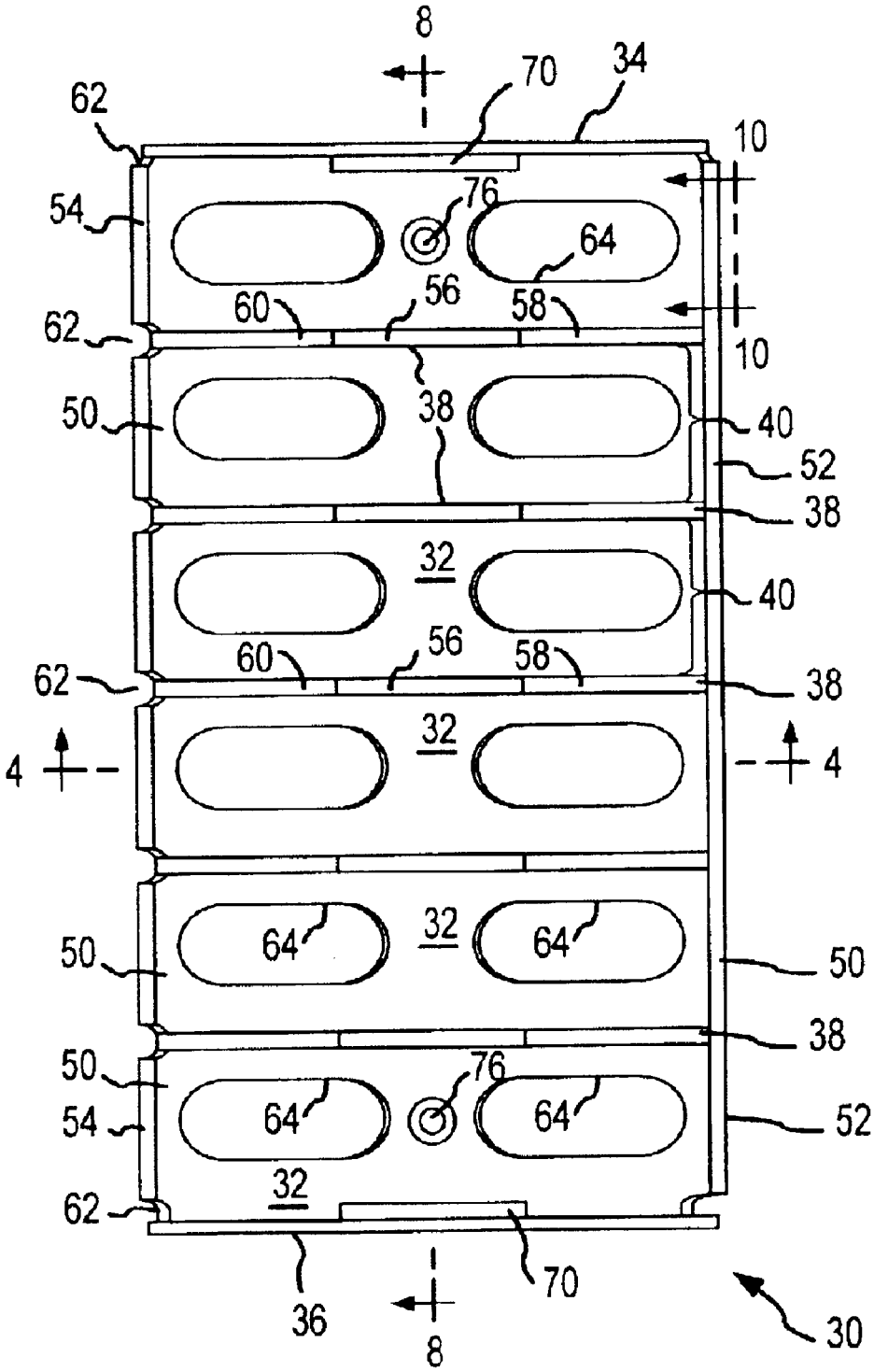
FIG. 3 is a front elevational view of the clip tray shown in FIGS. 1 and 2.

A clip tray 30, which embodies the present invention, is shown in FIGS. 1–3. The clip tray 30 is generally formed by a partial cylindrical back wall 32 to which end walls 34 and 36 are attached at opposite ends of the back wall 32. Dividers 38 project forward from the back wall 32 at positions which are spaced axially along an axis defined by the partial cylindrical back wall 32. The dividers 38 form receptacles 40 into which disk-like cylindrical shaped containers 42 are individually inserted. Each cylindrical container 42 is retained individually and separately from the other cylindrical containers 42 in its own receptacle 40.

The typical disk-like cylindrical shaped container 42 includes a pair of generally planar and parallel circular end walls 44 and 46 that are separated by a sidewall 48. Generally, one of the end walls, e.g. 44, is part of a lid for the container 42, while the other end wall 46 and the sidewall 48 form a repository or interior volume within which items are confined within the container 42. Access to this repository is obtained by removing the lid. The most prevalent form of such cylindrical containers 42 are made from plastic, however some cylindrical containers 42 are also made of stamped metal or composite paper.

Figure 5:
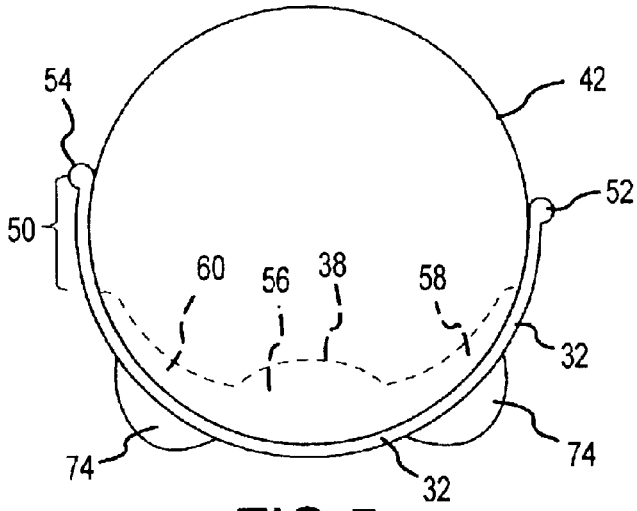
FIG. 5 is a view similar to FIG. 4 but also illustrating a cylindrical container retained in the clip tray.

The circumferential extent of the partial cylindrical back wall 32 is slightly more than 180 degrees. The back wall 32 therefore surrounds slightly more than half of the circumference of each cylindrical container 42 inserted into a receptacle 40. The greater than 180 degree circumferential contact by the back wall 32 with the cylindrical sidewall 48 holds each cylindrical container 42 within the receptacle 40 of the clip tray 30, as shown in FIG. 5.

Figure 6:
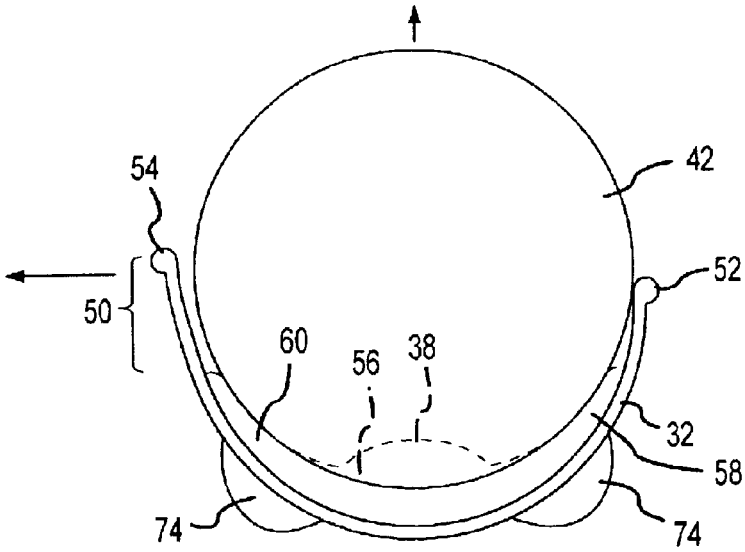
FIG. 6 is a view similar to FIG. 5 illustrating release of the cylindrical container from the position in which it is retained in the clip tray shown in FIG. 5.

Each cylindrical container 42 is released from its retained position within each receptacle 40 by deflecting a release tab 50 connected to a forward portion of the partial cylindrical back wall 32 associated with each receptacle 40, as shown in FIG. 6. Deflecting the release tab 50 outwardly removes a portion of the back wall 32 which forms the release tab 50 from contact with the cylindrical sidewall 48 of the container 42. With the release tab portion of the back wall 32 deflected out of contact with the cylindrical sidewall 48, the remaining portion of the back wall 32 does not contact more than 180 degrees of the circumference of the sidewall 50 of the container 42, and the container 42 is released from retention within the receptacle 40. The cylindrical container 42 may, at that point, be removed from the receptacle 40 by moving it out of the receptacle 40. By associating a single release tab 50 with each receptacle 40, the selected cylindrical container 48 may be removed individually from its own receptacle 40 without releasing or otherwise influencing the retention of the containers in the adjoining receptacles. Inserting each cylindrical container 42 in a receptacle 40 is not impeded because the release tab 50 deflects outwardly in a cam-like manner when the cylindrical container 42 is pushed into the receptacle 40.

In this manner, each cylindrical container 42 is individually displayed in and released from its own receptacle 40 within the clip tray 30. All of the individual containers 42 are readily apparent for selection and access. Each cylindrical container is individually retained in and released from its receptacle in a convenient manner by depressing the release tab 50, without disturbing reorienting or inadvertently releasing the other remaining cylindrical containers retained within the clip tray 30.

More details concerning the clip tray 30 are shown in FIGS. 1–6. The entire clip tray 30 is preferably formed from a single piece of injection molded plastic. Under such circumstances, all the components or elements of the clip tray 30 will be integrally connected with one another in the single plastic structure formed by injection molding. The type of plastic used to form the clip tray 30 provides the necessary strength, rigidity and flexibility to accomplish the functions described below. However, the clip tray 30 may also be formed by components which have not been integrally connected together.

The back wall 32 is described herein as a partial cylindrical configuration which makes surface contact with the cylindrical surface 48 of the container 42 over greater than 180 degrees of circumference to retain the container within the receptacle and over less than 180 degrees of circumference when the container is released for removal from the receptacle. Such surface contact is not required to retain and release the container, but instead point or edge contact with the cylindrical sidewall of the container is sufficient. In the case of point or edge contact, three contacts with the cylindrical sidewall should occur over greater than 180 degrees of circumference to retain the container within the receptacle. One of the contacts should be associated with the release tab so that when the release tab is moved outward, that one contact is no longer physically touching the cylindrical sidewall of the container. Under those circumstances the other two remaining contacts physically touch the cylindrical sidewall of the container over less than 180 degrees of its circumference and the container is thereby released from its retained position within the receptacle. Moreover, a combination of point or edge contacts and surface contact may be used. For example, the cylindrical container may makes surface contact with the cylindrical back wall 32 which is adjacent the dividers 38, while a point or edge contact element may be formed on the release tab 50 to contact the cylindrical sidewall at the greater than 180 degree location. Conversely, the release tab 50 may assume a partial cylindrical surface contact with the cylindrical sidewall while two or more point or edge contact elements may physically touch the cylindrical sidewall over the remaining circumferential portion which extends less than 180 degrees.

Figure 4:
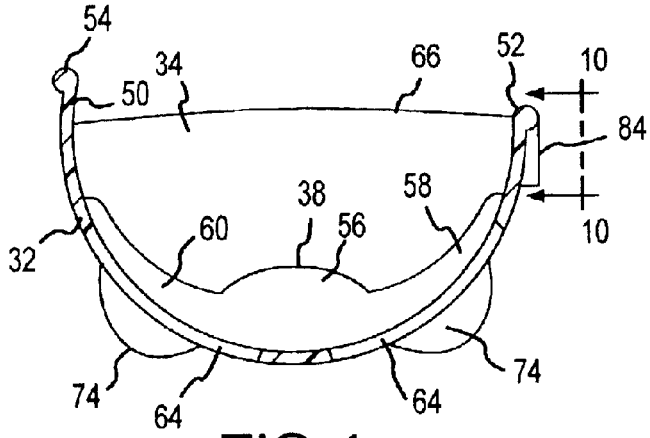
FIG. 4 is a transverse cross-sectional view taken substantially in the plane of line 4—4 of FIG. 3.

A forward end portion of the partial cylindrical back wall 32 terminates at a continuous edge 52. The other opposite forward end portion of the partial cylindrical back wall 32 terminates at an edge 54 on each of the release tabs 50. The continuous edge 52 and the release tab edges 54 have an enlarged rounded configuration to facilitate guiding the cylindrical containers 42 into the receptacles 40. The enlarged rounded configuration of the release tab edge 54 also facilitates applying thumb or finger pressure to deflect the release tab 50 outwardly relative to the receptacle 40 to thereby release the cylindrical container 42 from within each receptacle 40. The rounded configurations of the continuous edge 52 and the release tab edges 54 are greater in thickness than the thickness of the partial cylindrical back wall 32, as shown in FIGS. 4–6.

The dividers 38 separate the partial cylindrical volume within the clip tray 30 into the individual receptacles 40. The partial cylindrical volume within the clip tray 30 is defined by that volume enclosed by the partial cylindrical back wall 32 and the end walls 34 and 36. The dividers 38 are attached to, and project forward from, the back wall 32.

Each divider 38 includes a semicircular-shaped central protrusion 56 located approximately midway circumferentially along the back wall 32 between the continuous edge 52 and the edges 54 of the release tabs 50. Each divider 38 also includes two ribs 58 and 60 which extend on respectively opposite sides of the central protrusion 56. The rib 58 of each divider 38 extends from the central portion 56 toward the continuous edge 52, and the other rib 60 of each divider 38 extends from the central protrusion 56 in the opposite direction from the rib 58 toward the edges 54 of the release tabs 50. The forward end of each rib 58 terminates at a position adjacent to the continuous edge 52. The forward end of the each opposite rib 60 terminates adjacent to a rearward extending slot 62. The dividers 38 structurally reinforce the portion of the back wall 32 to which they are connected to maintain that back wall portion in the partial cylindrical configuration of the back wall 32. The structural reinforcement from the and the separation of each release tab 50 from the adjoining release tab by the slot 62 prevents the deflection of the release tab 50 from deflecting the structure of the adjoining receptacles in such a way that the cylindrical containers retained in the adjoining receptacles are inadvertently released.

The slots 62 divide the forward portion of the back wall 32 into the release tabs 50. Each slot 62 extends rearward into the partial cylindrical back wall 32 to a location where the circumferential distance from the maximum rearward point of the slot 62 to the continuous edge 52 on the opposite side of the back wall 32 is less than 180 degrees, as understood from FIG. 6. Consequently, the first portion of the back wall 32 which is formed by the release tab 50 retains the cylindrical container 42 in the receptacle 40. The second portion of the back wall 32 formed by the release tab 50 extends the amount of circumferential contact with the cylindrical sidewall 48 of the container 42 (FIG. 1) to an amount of greater than 180 degrees. The normal position of the release tab 50 (FIG. 5) holds the cylindrical container 42 in the receptacle 40. The outward deflection of the release tab 50 (FIG. 6) releases contact of the back wall 32 with more than 180 degrees of the circumferential distance of the sidewall 48 of the container 42 (FIG. 1), thereby releasing and freeing the container 42 for movement out of the receptacle 40.

The slots 62 and the dividers 38 cause the portion of the back wall 32 which defines one release tab 50 to deflect or flex slightly outward independently of the movement of the remaining first portion of the back wall 32 or any of the portions of the cylindrical back wall of the adjoining receptacles 40. Slots 62 are also formed into the back wall 32 at the two end receptacles 40 of the clip tray 30 and extend from the release tab edges 54 to the adjacent end walls 34 and 36. In this manner the release tabs 50 for the two end receptacles 40 are associated only with those receptacles and also function in the same manner as the release tabs 50 for the receptacles located between the end receptacles.

The two ribs 60 of two adjacent dividers 38 which define a single receptacle extend forward to the locations where the slots 62 end. Terminating the forward end of the ribs 60 at the slots 62 assures that the first portion of back wall 32 which extends from the forward ends of the ribs 60 along the divider 38 to the forward end of the opposite ribs 58 of the divider 38 will maintain the partial cylindrical configuration, while only the second portion of the back wall 32 which defines the release tabs 50 between the slots 62 will deflect outwardly in response to pressure, as shown in FIG. 6. Thus, the ribs 60 assure that only the individual release tabs 50 upon which pressure is applied will flex outwardly to release only the intended container. The ribs 60 assure that pressure applied on a release tab will not be sufficient to cause a container 42 to be released unintentionally from an adjacent receptacle 40.

In addition to dividing the cylindrical volume within the clip tray 30 into the receptacles 40, the dividers 38 facilitate inserting the cylindrical containers 42 into the receptacles 40. The forward projecting edges of the ribs 58 and 60 contact the parallel end walls 44 and 46 of each container 42 to guide the container into the receptacle 40. The central protrusion 56 of the divider 38 extends between adjacent containers 42 when they are retained in the clip tray 30 to add further stability and separation while the containers are retained and as they move into and out of their receptacles.

To facilitate removing the containers 42 from the receptacles 40, elongated openings 64 are formed in the partial cylindrical back wall 32 on opposite lateral circumferential sides of each receptacle, as shown in FIGS. 1–3. The elongated openings 64 permit finger pressure to be applied on the back sidewall of each cylindrical container 42, to move the container forward as shown in FIG. 6 and out of the receptacle, when the release tab 50 is moved outward. Each opening 64 is therefore positioned so that a finger can conveniently reach around the clip tray 30 and behind the back wall 32 and through one of the openings 64 to move the container 42 forward out of the receptacle 40 while deflecting the release tab. To facilitate this ergonomic relationship, each opening 64 is located in a parallel relationship between the ribs 58 and 60, beginning at a circumferential position near the outward extent of each central protrusion 56 on opposite lateral sides of a centerline through the clip tray 30, as may be understood by reference to FIG. 3.

The openings 64 are also useful in allowing light to enter the receptacles and illuminate the containers within the receptacle. The light can be directed into their receptacles from a light source located behind the clip tray 30, or natural ambient light can enter through the openings 64. In either circumstance, eliminating the containers within each receptacle facilitates identification of a selected container by viewing its contents or by viewing a label or other identification attached to the container.

Each end wall 34 and 36 has a forward edge 66 which curves slightly radially outward, as shown in FIG. 4. Each end wall 34 and 36 is generally semicircular in shape and lies in a plane which is perpendicular to the partial cylindrical back wall 32. The slots 62 adjacent to the end release tabs 50 of the clip tray 30 extend from the rounded ends 54 to the forward edges 66 of each end wall 34 and 36. This slight radial curvature creates an aesthetic appearance for the clip tray 30.

Each end wall 34 and 36 also includes semicircular cutout portion 68, and a correspondingly shaped semicircular portion 70 is located slightly axially inward from each of the end walls 34 and 36. The semicircular portion has a shape which corresponds to the shape semicircular cutout portion and each central protrusion 56 of each divider 38.

The semicircular portion 70 extends perpendicularly forward relative to the back wall 32 in a manner which is parallel to the central protrusions 56 of each divider 38. The axial distance between the semicircular portion 70 and the central protrusion 56 of the adjoining divider 38 is approximately the same axial distance as between the equally-spaced dividers 38. Thus, the semicircular portions 70 adjacent to the end walls 34 and 36 function as partial dividers for the end receptacles 40 of the clip tray 30. The semicircular portions 70 also facilitate the direct movement of the cylindrical containers 42 into the receptacles 40 which are located at the opposite ends of the interior or volume of the clip tray 30, in the same manner that the central protrusions 56 of the dividers 38 facilitate movement of the cylindrical containers 42 into the intermediate recesses within the clip tray 30.

The cutout portion 68 in each end wall 34 and 36, combined with the radial outward curvature of the forward edges 66 of the end walls 34 and 36, establish a portion 72 of each end wall 34 and 36 which is shaped somewhat similar to a bow tie configuration. The bow tie portion 72 of the end walls 34 and 36 extends perpendicularly relative to the back wall 32. The bow tie portion 72 of the end walls 34 and 36 facilitates positioning and orienting the clip tray 30 as described below.

Figure 7:
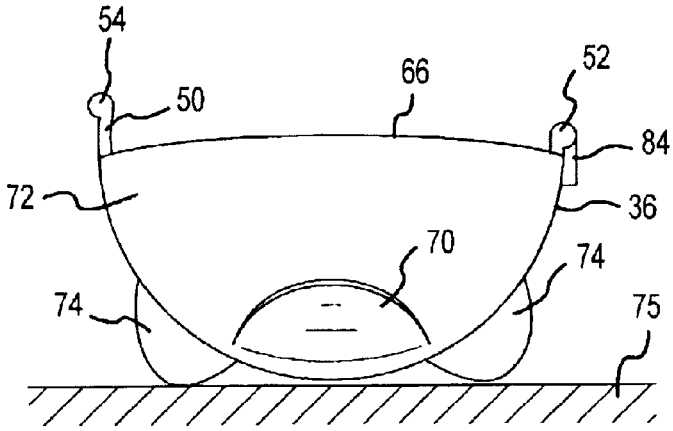
FIG. 7 is an end elevational view illustrating the clip tray shown in FIGS. 1 and 2 resting on a horizontal surface.

Positioning and orienting the clip tray 30 as a self-supporting, stand-alone item is facilitated by four feet 74, as shown in FIGS. 2 and 4–7. The feet 74 are attached to and project outwardly from the back side of the partial cylindrical back wall 32 at opposite ends of the clip tray 30 and on opposite sides of an axial centerline through the partial cylindrical back wall 32, as shown in FIG. 4. The four feet 74 support the clip tray 30 from horizontal support 75, as shown in FIG. 7. Supported in this manner, the receptacles 40 within the clip tray 30 face upward. The cylindrical containers 42 are inserted vertically downward into the receptacles 40 and are removed vertically upward out of those receptacles. The feet 74 therefore allow the clip tray 30 to be self supported a portable display or a portable organizer.

Figure 8:
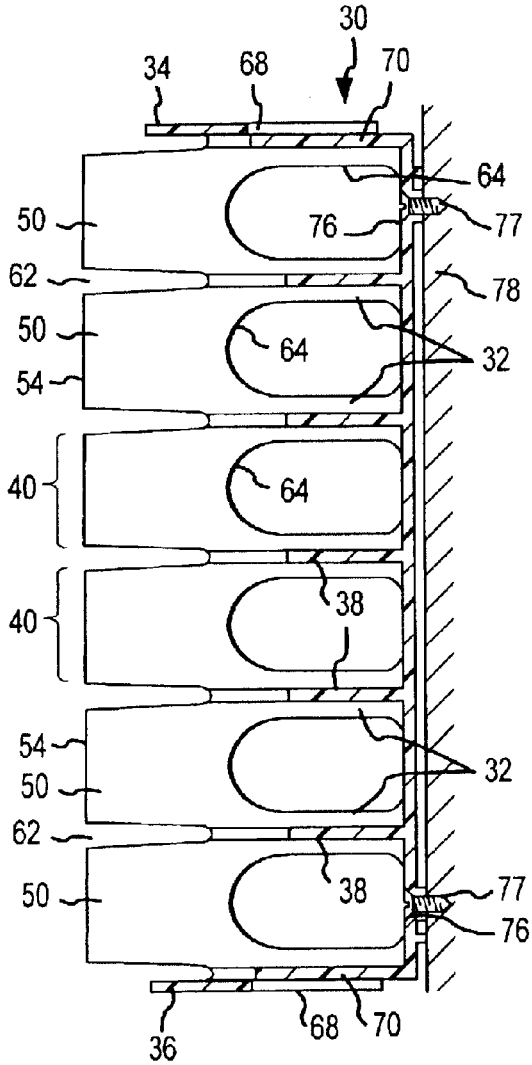
FIG. 8 is a longitudinal cross-sectional view taken substantially in the plane of line 8—8 of FIG. 3, illustrating the clip tray connected to a vertical support by screws.

Attachment holes 76 are formed through the partial cylindrical back wall 32 at a position approximately midway between the continuous edge 52 and the edges 54 of the release tabs 50, as shown in FIG. 3. Screws 77 are inserted through the attachment holes 76 and connected into a vertical support 78 to orient and connect the clip tray 30 as shown in FIG. 8. Although the attachment holes 76 are shown having round configurations, alternative attachment holes can be formed in the configuration of a conventional key slot, with the slot portion of the key slot oriented axially. The use of the conventional key slot allows the clip tray 30 to be inserted over pre-positioned screws or fasteners, and then moved axially so that a shank of the screw or fastener moves into the slot portion of the key slot. Conventional detents are preferably located in the key slot to prevent the shanks of the screws or fasteners from moving out of the key slot, thereby retaining the clip tray 30 in its installed position.

Although FIG. 8 shows the clip tray 30 in a vertical orientation, the clip tray may be attached in horizontal orientation to vertical support or in a horizontal orientation to a horizontal support by use of the screws 77 extending through the attachment holes 76. When attached in any of these configurations by use of fasteners extending through the attachment holes 76, the feet 74 stabilize the clip tray against lateral tilting movement.

Figure 9:
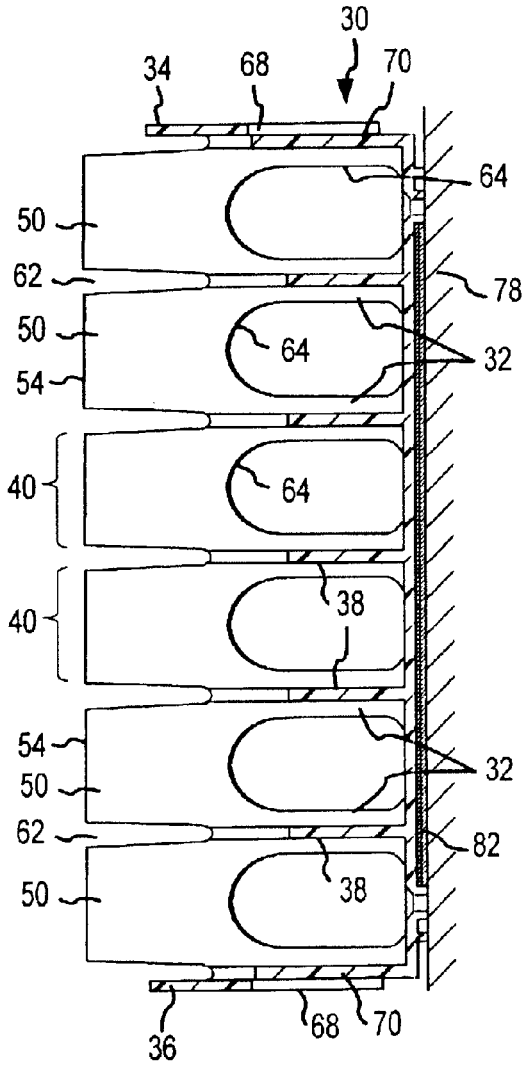
FIG. 9 is a view similar to FIG. 8, illustrating the clip tray connected to a vertical support by double backed tape or a loop and hook fastener.

A rear surface of the cylindrical back wall 32 includes a relatively narrow axially extending attachment portion 80 which extends approximately from one end wall 34 to the other 36, as shown in FIG. 2. The attachment portion 80 encompasses the attachment holes 76. The attachment portion 80 provides a surface upon which to attach double backed tape 82 to attach the clip tray 30 as shown in FIG. 9. One adhesive side of the tape 82 is attached to the attachment portion 80, and the other adhesive side of the tape 82 is attached to the support surface 78. The clip tray 30 can be attached in this manner to a vertical or horizontal surface.

In a manner similar to the attachment provided by the double backed tape 82 shown in FIG. 9, a conventional hook and loop fastener (not shown), such as Velcro, can be used to position and orient the clip tray 30. One separable portion of the hook and loop fastener is attached to the attachment portion 80 with an adhesive. The other separable mating portion of the hook and loop fabric fastener is attached to the support surface 78. The fastener portion attached to the clip tray 30 is then brought into contact with the fastener portion attached to the support surface 78. The hooks and loops of the fastener mesh with each other to hold the clip tray 30 in the position established by the orientation of the fastener portions on the attachment portion 80 and on the support 78. The advantage of using a conventional hook and loop fastener in this manner is that the clip tray 30 can be moved easily from one location and transferred to another location where another mating fastener portion is located, by separating the separable portions of the hook and loop fastener at one location and reconnecting the fastening portions at the other location. The feet 74 also stabilize the clip tray 30 when attached to a support by the double back or the hook and loop fasteners.

Figure 10:
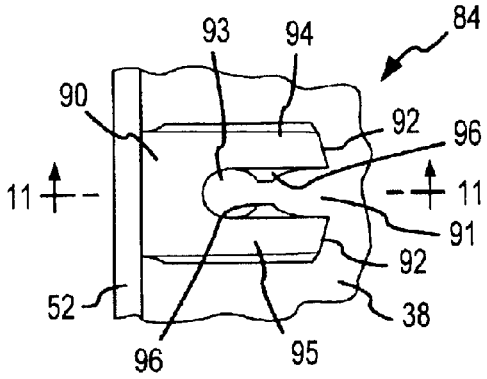
FIG. 10 is a partial enlarged view of a side portion of the clip tray taken substantially from the elevation of lines 10—10 of FIGS. 3 and 4.
Figure 11:
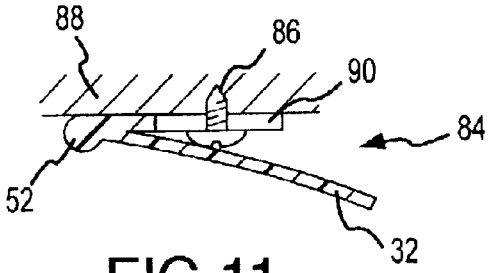
FIG. 11 is a cross-sectional view taken substantially in the plane of line 11—11 of FIG. 10.
Figure 12:
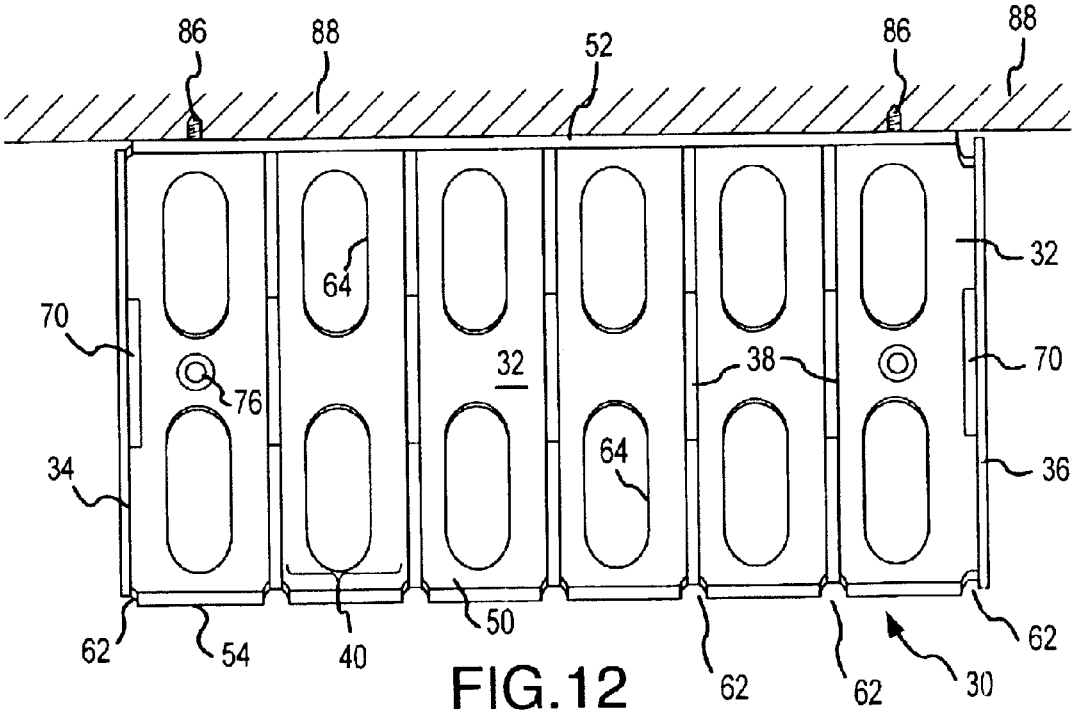
FIG. 12 is a front elevation view illustrating the clip tray shown in FIGS. 1 and 2 supported in a horizontal orientation below a horizontal support by use of the features shown in FIGS. 10 and 11.

The tray clip 30 also includes edge retainers 84, shown in FIGS. 1, 2, 10 and 11. The edge retainers 84 interact with screws 86 in a support 88 as shown in FIG. 12 to hold the tray clip 30 to the support 88. The edge retainers 84 can be used to hold the tray clip 30 in multiple orientations, but the preferred use is shown in FIG. 12. Each edge retainer 84 is formed by a bifurcated tab 90 which extends rearwardly from the continuous edge 52, as shown in FIG. 10. The bifurcated tab 90 is defined by a slot 91 which extends from a rearward edge 92 of the tab 90 forward to an opening 93. The slot 91 defines two arm portions 94 and 95 which face each other across the slot 91. Each arm portion 94 and 95 includes a detent 96 which directly faces the detent 96 of the other arm portion. The opening 93 is generally circular in shape, and the slot 91 is generally uniform in width along its length except at the location where the detents 96 face one another.

The width of the slot 91 is adapted to allow the shank of the screw 86 to be moved along it. When the shank of the screw 86 encounters the detents 96, continued movement of the clip tray 30 rearwardly relative to the screw 86 forces the arm portions 94 and 95 to deflect outward slightly apart from one another to allow the shank of the screw 86 to pass the detents 96 and enter the opening 93. As the shank of the screw 86 enters the opening 93, the resiliency of the bifurcated tab 90 causes the arm portions 94 and 95 to move back toward one another and to assume the original position shown in FIG. 10. In this original position, the detents 96 trap the shank of the screw 86 within the opening 93, thereby firmly retaining the clip tray 30 relative to the screws 86 positioned in the support 88.

Removing the clip tray from its position retained by the edge retainers 84 relative to the screws 86 is accomplished by grasping the clip tray 30 and pulling at forward. The forward movement causes the shank of the screw 86 to contact the detents 96 and force the resilient arm portions 94 and 95 apart, thereby releasing the screw shank from the opening 93 and allowing it to slide out of the slot 91, thereby disconnecting the clip tray from the screws 86. The edge retainers 84 allow the clip tray 30 to be moved from one retained location to another location where screws 86 have been previously located in a support 88. Alternatively, the edge retainers 84 allow the clip tray 30 to be permanently maintained in a single location.

Figure 13:
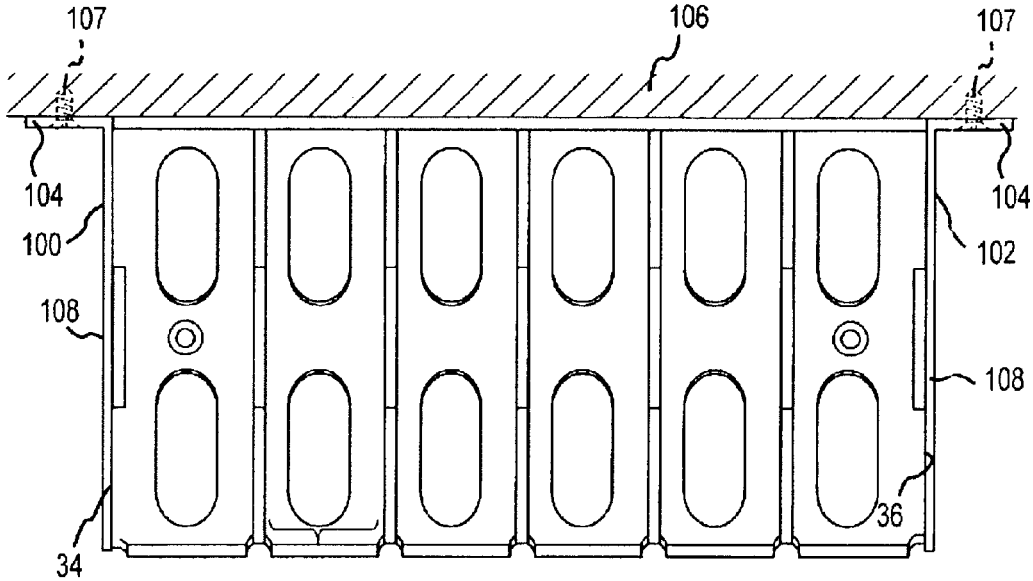
FIG. 13 is a front elevation of view illustrating the clip tray shown in FIGS. 1 and 2 supported in a horizontal orientation below a horizontal support by attachment brackets.
Figure 14:
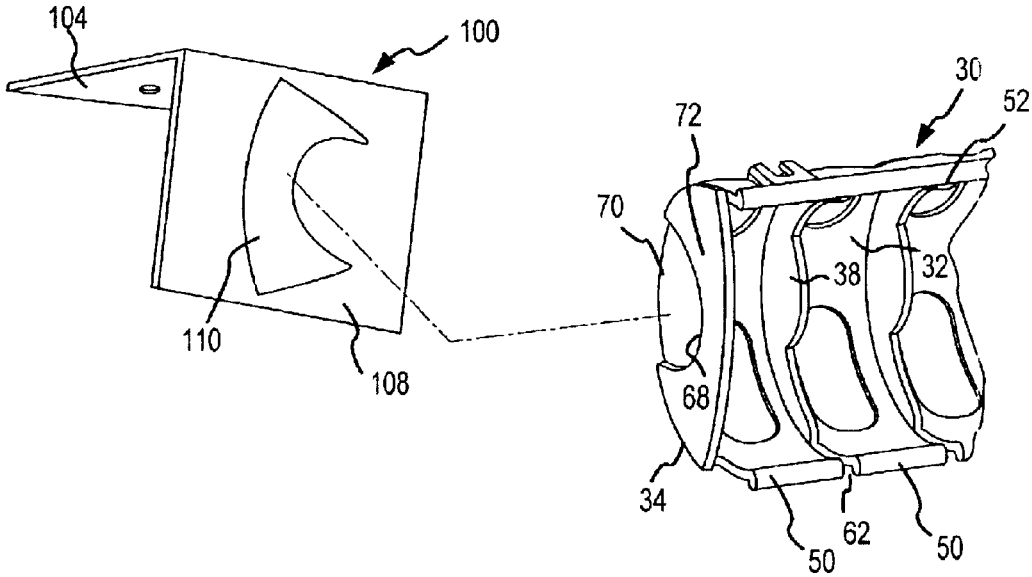
FIG. 14 is a perspective view of one end of the attachment bracket shown in FIG. 13 shown in exploded relationship relative to an end wall of the clip tray shown in FIGS. 1 and 2 shown in a different perspective than the attachment bracket.

The clip tray 30 may also be positioned and oriented by use of end wall attachment brackets 100 and 102, as shown in FIGS. 13 and 14. The end wall attachment brackets 100 and 102 have configurations which are mirror images of each other. Each end wall attachment bracket 100 and 102 includes an attachment flange 104 used to attach each bracket 102 or 104 to a support 106. The attachment flange 104 defines the hole through which a screw 107 extends to connect the attachment flange 104, and thus connect each entire attachment bracket 100 or 102, to the support 106. Each end wall attachment bracket 100 and 102 is preferably made from a single integral piece of plastic, which has been injection molded, although the attachment brackets 100 and 102 can also be made from other materials and separate parts which are connected together.

Each attachment bracket 100 and 102 also includes an end wall support flange 108 which contacts the end wall 34 or 36 of the clip tray 30. The end wall support flange 108 of the attachment bracket 100 contacts the end wall 34, while the end wall support flange 108 of the attachment bracket 102 contacts the end wall 36, as shown in FIG. 13. The end wall support flanges 108 of the brackets 100 and 102 generally have the same configuration, although the configurations are mirror images of one another.

Each end wall support flange 108 includes a cutout portion 110 of a complementary shape to the bow tie shaped portion 72 (also see FIG. 7) of the end walls of the clip tray 30. The bow tie shaped cutout portions 110 of each end wall support flanges 108 receive the bow tie shaped portion 72 of the end walls 34 and 36 of the clip tray 30 when the end wall support flanges 108 contacts the end walls, of the clip tray 30.

By inserting the bow tie shaped portions 72 of the end walls 34 and 36 into the bow tie shaped cutout portions 110 of the attachment brackets 100 and 102, as shown in FIG. 13, the clip tray 30 is retained and supported by the attachment brackets 100 and 102. The configuration of the bow tie shaped portions 72 of the end walls 34 and 36, and the complementary configuration of the bow tie shaped cutout portions 110 of the end wall support flanges 108 prevent the clip tray from rotating relative to the attachment brackets 100 and 102. The end wall support flanges 108 of the attachment brackets 100 and 102 resiliently deflect outward (left and right, respectively, as shown in FIG. 13) to permit the clip tray 30 to be inserted between them. Once properly inserted, the resiliency of the attachment brackets moves the support flanges 108 against the end walls 34 and 36, to retain and orient the clip tray 30. The attachment brackets 100 and 102 can be used to orient the clip tray 30 in a horizontal position above or below a horizontal support 106, or in a vertical orientation relative to a vertical support surface.

Figure 15:
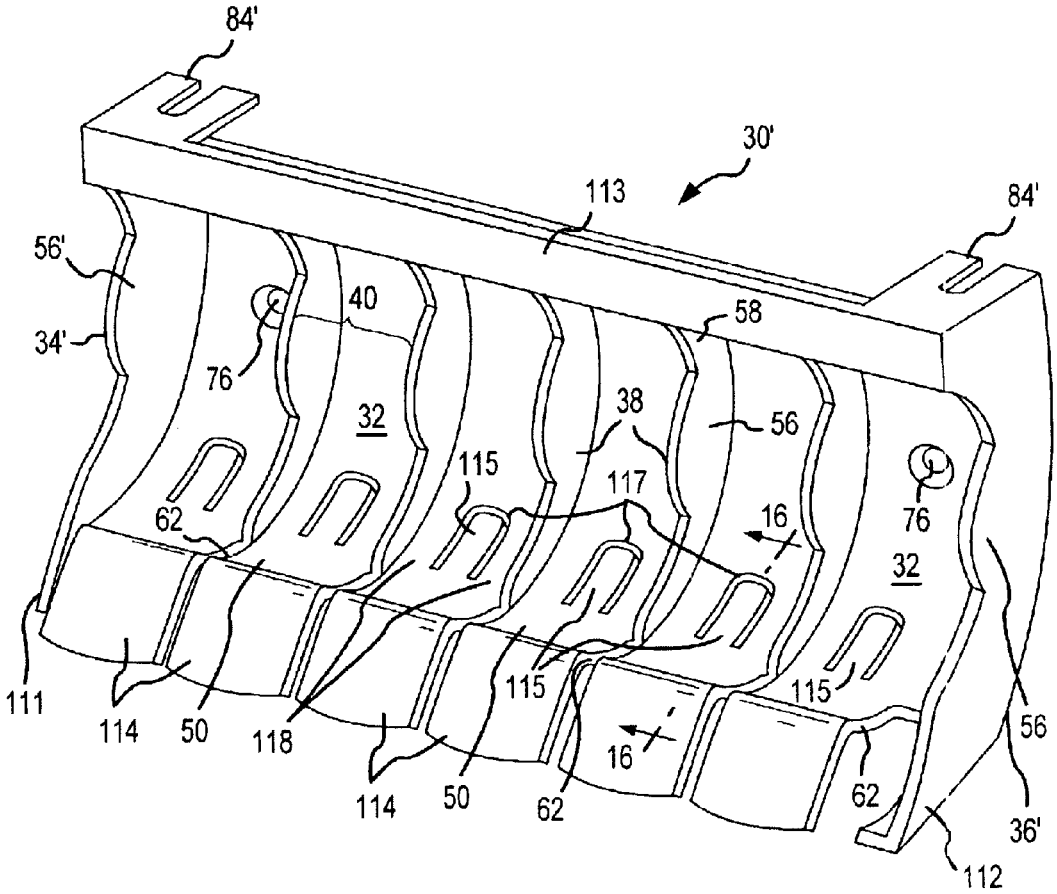
FIG. 15 is a perspective view of another embodiment of the clip tray shown in FIGS. 1–3.
Figure 16:
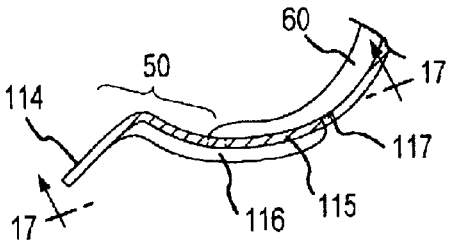
FIG. 16 is a partial cross-sectional view taken substantially in the plane of line 16—16 of FIG. 15.
Figure 17:
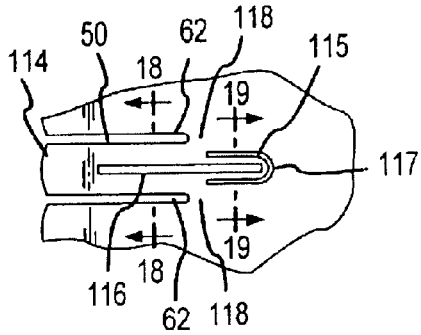
FIG. 17 is a partial view taken substantially in the plane of line 17—17 of FIG. 16.
Figure 18:
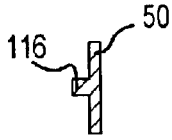
FIG. 18 is a partial cross-sectional view taken substantially in the plane of line 18—18 of FIG. 17.
Figure 19:
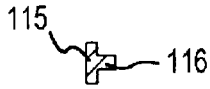
FIG. 19 is an exploded perspective view of one embodiment of a carousel which includes a plurality of the clip trays shown in FIGS. 1 and 2.

A self-supporting version 30' of the clip tray, which provides horizontal access to the cylindrical containers 42 (FIG. 1), is illustrated in FIG. 15. The clip tray 30' includes end walls 34' and 36' which have been modified to include support feet 111 and 112, respectively. The support feet 111 and 112 extend sufficiently to support the receptacles 40 above a horizontal surface, so that each of the receptacles 40 generally faces or opens in a horizontal direction. The support feet 111 and 112 cause the clip tray 30' to be self-supporting when placed on a horizontal surface. The end walls 34' and 36' also do not include the semicircular cutout portion 68 or the semicircular portion 70 (FIG. 14), but the end walls 34' and 36' do include central protrusions 56' which are similar to the corresponding central protrusions 56 of the dividers 38.

Near the junction of each end wall 34' and 36' with the common back wall 32 of the receptacles 40, a pair of edge retainers 84' are located. Each edge retainer 84' is similar to the edge retainer 84 described in FIGS. 10–12. The edge retainers 84' are used in the same manner as the edge retainers 84 are used to position and retain the clip tray 30' relative to a horizontal support. In general, however, the edge retainers 84' will be used to support the clip tray 30' beneath a horizontal support, while the support feet 111 and 112 will be used to support the clip tray 30' in a self-supporting manner above a horizontal support.

The rounded continuous edge 52 of the clip tray 30 (FIG. 1) has been replaced by a planar continuous edge 113 in the clip tray 30'. The planar edge 113 extends axially along the edge of the receptacles 40 at which the ribs 58 terminate. The planar edge 113 permits information to be displayed relative to the containers 42 which are retained within the clip tray 30'. For example, the planar edge 113 may present advertisements or indications describing the type of contents within the cylindrical containers located in the receptacles 40 beneath the planar edge 113.

In the clip tray 30', the rounded edges 54 of the release tabs 50 (FIG. 1) have been replaced by push levers 114. The push levers 114 are contacted and pushed downward (as shown in FIG. 15) by finger pressure to deflect the release tabs 50 outward (downward as shown in FIG. 15). Pushing the levers 114 moves the release tabs 50 outward to establish less than 180 degrees of circumferential contact with the cylindrical sidewall of the containers and thereby release the cylindrical containers from their retained position within the receptacles 40. The push levers 114 thus transmit the finger pressure necessary to move the release tabs 50 and release the cylindrical containers from their receptacles, in an manner to the way that the rounded edges 54 (FIG. 1) transmit the finger pressure necessary to move the release tabs 50. However, the downward orientation of the push levers 114 when the clip tray 30' is oriented horizontally as shown in FIG. 15, facilitates release of the cylindrical containers from within the receptacles 40.

The back walls 32 of each receptacles 40 in the clip tray 30' may not be formed with access openings 64 by which to apply finger pressure to the containers for removing them from the receptacles, as is the case with the clip tray 30 (FIG. 2). Instead, removing the cylindrical containers from the receptacles 40 is facilitated by use of a release arm 115 in the clip tray 30'. As a shown in FIGS. 16–19, each release arm 115 is rigidly connected to an associated release tab 50 by a support rib 116. The support rib 116 extends along the back portion of the back walls 32 from which the release tab 50 and the release arm 115 are formed. The release arm 115 is separated from the back walls 32 of each receptacle by a U-shaped cutout 117. The support rib 116 causes the release arm 115 to deflect simultaneously with deflection of the release tab 50, with both the release tab 50 and the release arm 115 pivoting around a portion 118 of the back wall 32 adjacent to the slots 62 that maintains the release tab 50 and the release arm 115 connected to the back wall 32. The portion 118 of the back wall 32 that connects the release tab 50 and the release arm 115 also resiliently pivots in a manner similar to a fulcrum when the release tab is deflected outward as a result of finger pressure on the push levers 114. When the release tab 50 is deflected outward, the release arm 115 is deflected upward into the receptacle 50.

Each release arm 115 extends rearward within each receptacle 40 to the maximum extent of each U-shaped cutout 117. Each release arm 115 therefore extends rearward within that region of the back wall 32 which makes less than 180 degrees of circumferential contact with the cylindrical container. When the release tab 50 is pivoted outward, the rear end of the release arm 115 moves slightly upward within the receptacle 40. This slightly upward movement of the rear end of the release arm contacts the cylindrical sidewall of the container in a way which induces force on the container to urge it out of the receptacle. Thus, the release arm 115 causes the cylindrical container to apply a slight force to move the cylindrical container out of the receptacle 40 simultaneously with the deflection of the release tab 50 and the release of the container from within the receptacle 40. In this manner, the cylindrical container is removed by simultaneously releasing it and urging it out of the receptacle 40.

Although openings 64 (FIG. 2) are not provided in the back wall 32 of each receptacle in the clip tray 30', at least one such opening 64 could be obtained by locating that opening 64 adjacent to the ribs 58. In this manner, the opening 64 allows light to enter the receptacle 40, or in the appropriate circumstances, the opening 64 could be used to apply finger pressure for further urging the container out of the receptacle. Likewise, release arms 115 could be incorporated with the release tabs 50 in the clip tray 30 (FIGS. 1–3), although the access openings 64 adjacent to the ribs 60 would be eliminated in order to provide a sufficient amount of the back wall 32 within which to define the release arm 115 in the manner described.

In addition to positioning and orienting each individual clip tray 30, a multiplicity of clip trays may be organized into a larger assembly, such as the carousels shown in FIGS. 20–23. In each case, the multiplicity of clip trays 30 increases the number and availability of cylindrical containers 42 which may be presented, displayed, organized and dispensed.

Figure 20:
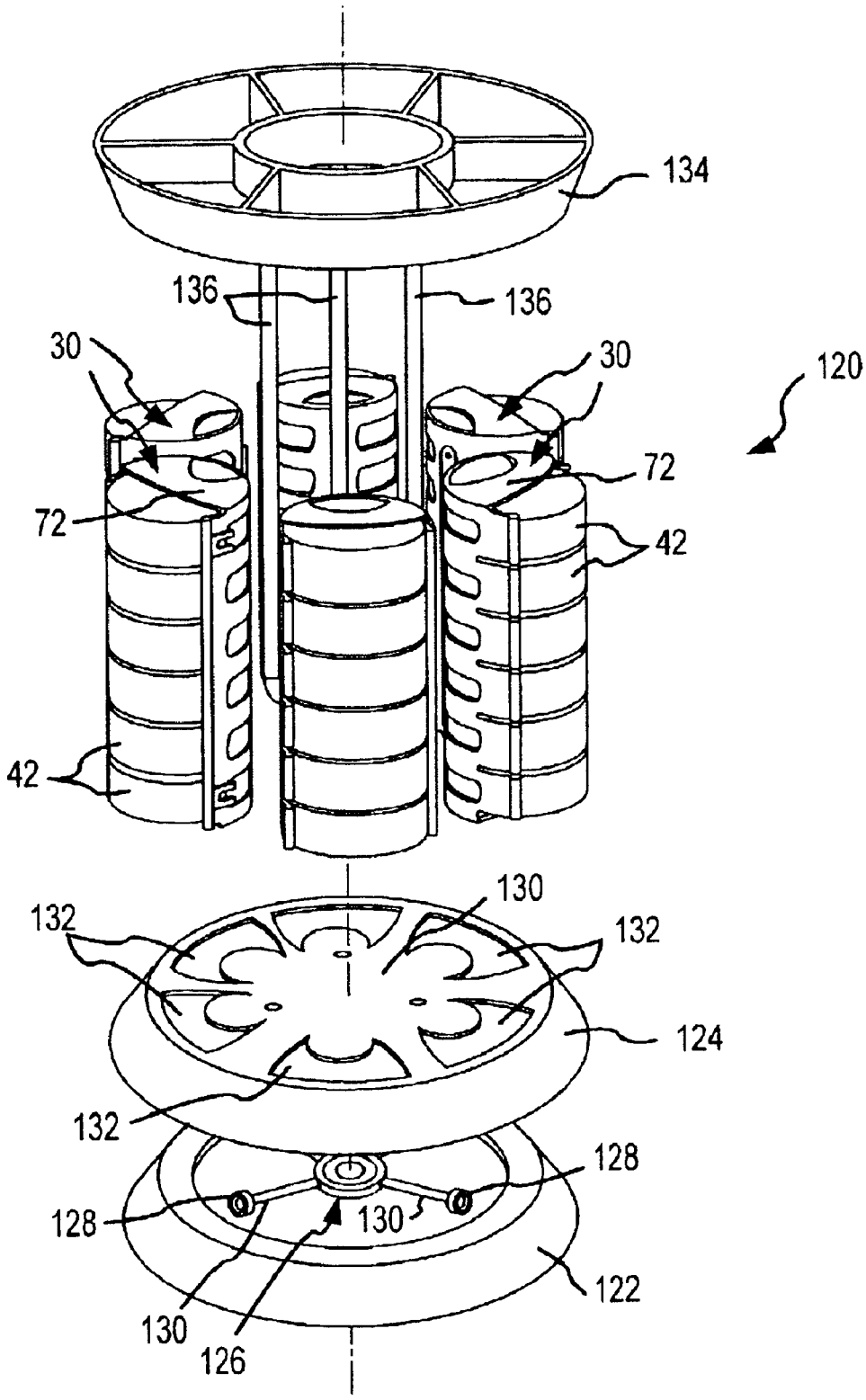
FIG. 20 is an exploded perspective view of another embodiment of a carousel which includes a plurality of the clip trays shown in FIGS. 1 and 2.

One type 120 of a carousel which is formed by a multiplicity of clip trays 30 is shown in FIG. 20. The carousel 120 includes a stationary base member 122, upon which a bottom plate member 124 is rotationally attached by a spoked arm member 126. The spoked arm member 126 has wheels 128 rotationally attached at the end of each of its plurality of spoked arms 130. The spoked arm member 126 is positioned between the base member 122 and the bottom plate member 124. When the wheels 128 roll on an upper surface of the stationery base member 122, the bottom plate member 124 is rotated by those wheels relative to the base member 122. Although not shown in FIG. 20, a motor may be located within the base member 122 to rotate the spoked arm member 126, and thereby cause rotation of the bottom plate member 124 and all the other elements of the carousel 120 connected to the bottom plate member 124.

An upper surface 130 of the bottom plate member 124 includes a plurality of bow tie shaped recesses 132 positioned at regularly spaced circumferential intervals around the bottom plate member 124. Each of the bow tie shaped recesses 132 is similar in configuration and size to the bow tie shaped cutout portions 110 of the end wall support flanges 108 of the attachment brackets 100 and 102 previously described in conjunction with FIGS. 13 and 14. The bow tie shaped portions 72 of the end walls 34 or 36 of the clip trays 30 fit into the bow tie shaped recesses 132, when the clip trays 30 are oriented vertically relative to the bottom plate member 124. As shown in FIG. 20, a plurality of clip trays 30 (six are shown) extend vertically upward from the bottom plate member 124.

A top plate member 134 also includes similarly shaped recesses 132 (not shown) which receive the bow tie shaped portions 72 of the other end walls of the clip trays 30, while the clip trays 30 are oriented in the vertical orientation relative to the bottom plate member 124. Connection rods 136 extend between the top and bottom plate members 134 and 124 to retain the two plate members 124 and 134 in a fixed spaced apart position, thereby retaining the plurality of clip trays 30 in the carousel configuration 120.

Figure 21:
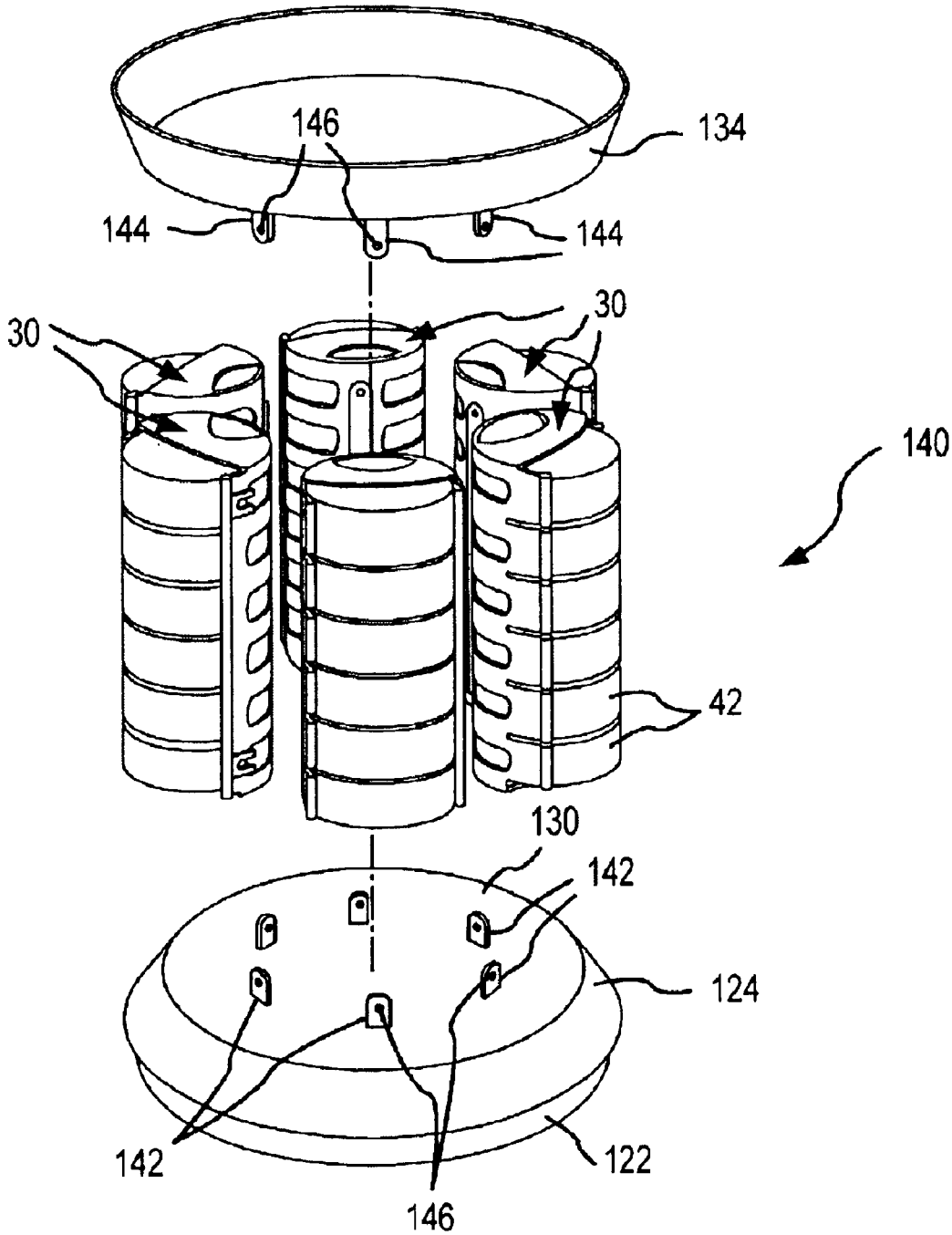
FIG. 21 is an exploded perspective view of still another embodiment of a carousel which includes a plurality of the clip trays shown in FIGS. 1 and 2.

Another type 140 of a carousel made from a plurality of clip trays 30 is shown in FIG. 21. The carousel 140 is similar in configuration to the carousel 120 (FIG. 20), except that the bottom and top plate members 124 and 134 include flanges 142 and 144 which extend upwardly and downwardly from the plate members 124 and 134, respectively. The flanges 142 and 144 include holes 146 which align with the attachment holes 76 (FIGS. 1–3 and 8) formed in the back wall 32 of each clip tray 30. Screws (not shown in FIG. 21) extend through the attachment holes 76 and into the holes 146 of the flanges 142 and 144 to attach each clip tray 30 to the top and bottom plate members 134 and 124. Once all of the clip trays 30 have been attached in this manner, the bottom and top plate members 124 and 134 and the plurality of clip trays 130 form a sufficiently unified and rigid structure to maintain the integrity of the carousel 140.

Figure 22:
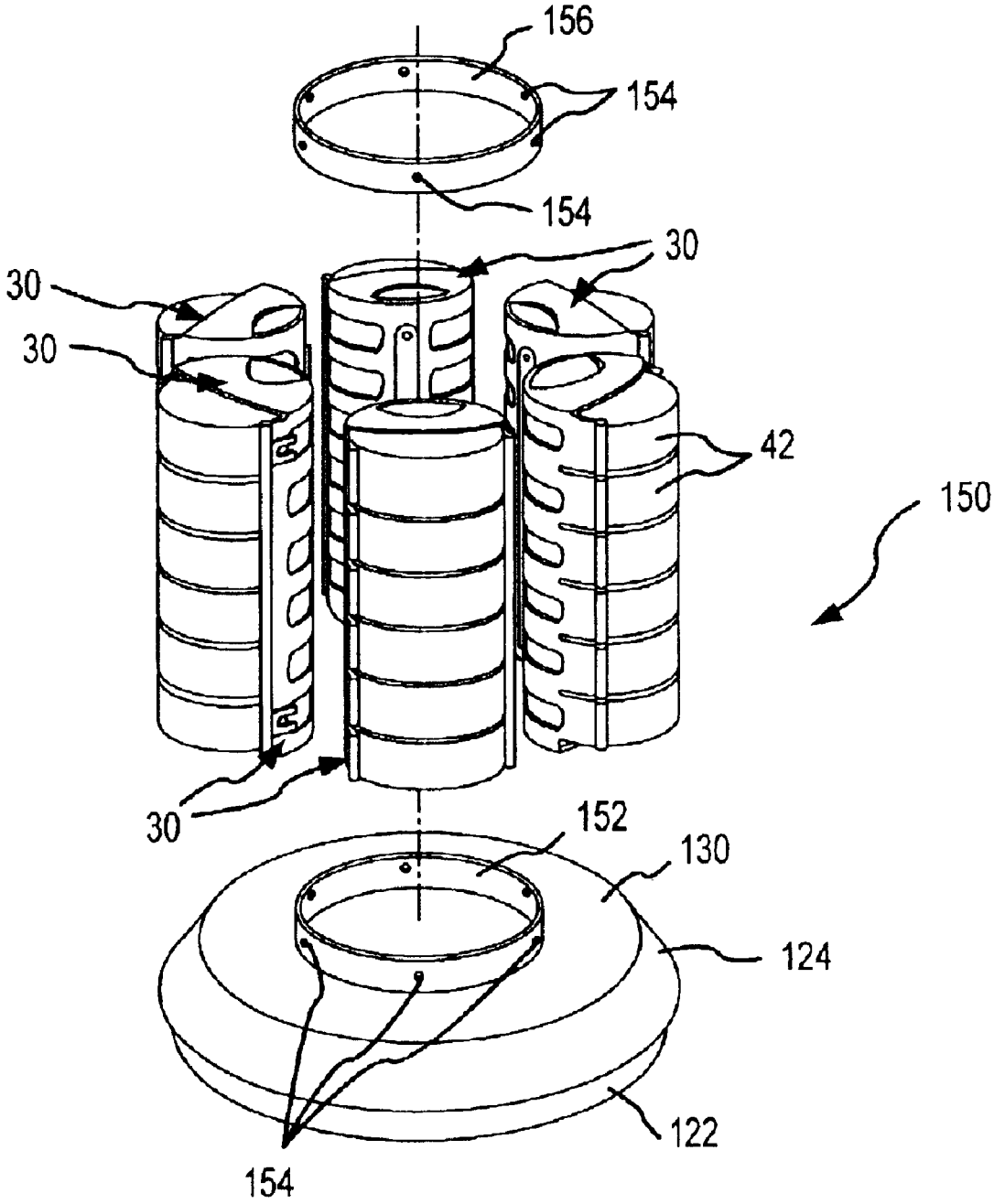
FIG. 22 is an exploded perspective view of yet another embodiment of a carousel which includes a plurality of the clip trays shown in FIGS. 1 and 2.

Another type 150 of a carousel is shown in FIG. 22. In the carousel 150, a circular bottom collar 152 is attached to and extends upward from an upper surface 130 of the bottom plate member 124. The bottom collar 152 includes attachment holes 154 which align with the attachment holes 76 (FIGS. 1–3 and 8) of the clip trays 30. A separate top collar 156 also includes alignment holes 152. This separate top collar is connected to the upper attachment holes 76 of the clip trays 30 in the same way to stabilize and orient the upper ends of the clip trays 30 once they are attached to the bottom collar 152. In the configuration of the carousel 150 shown in FIG. 22, a top plate member 134 (FIGS. 20 and 21) is not required. However, the top collar 156 may be attached to a top plate member in the same manner that the bottom collar 152 is attached to the bottom plate member 124 in those circumstances where a top plate member is desired for use in the carousel 150. In those circumstances, the resulting carousel 150 would appear essentially similar in its assembled configuration to the carousels 120 and 140 shown in FIGS. 20 and 21, respectively.

Figure 23:
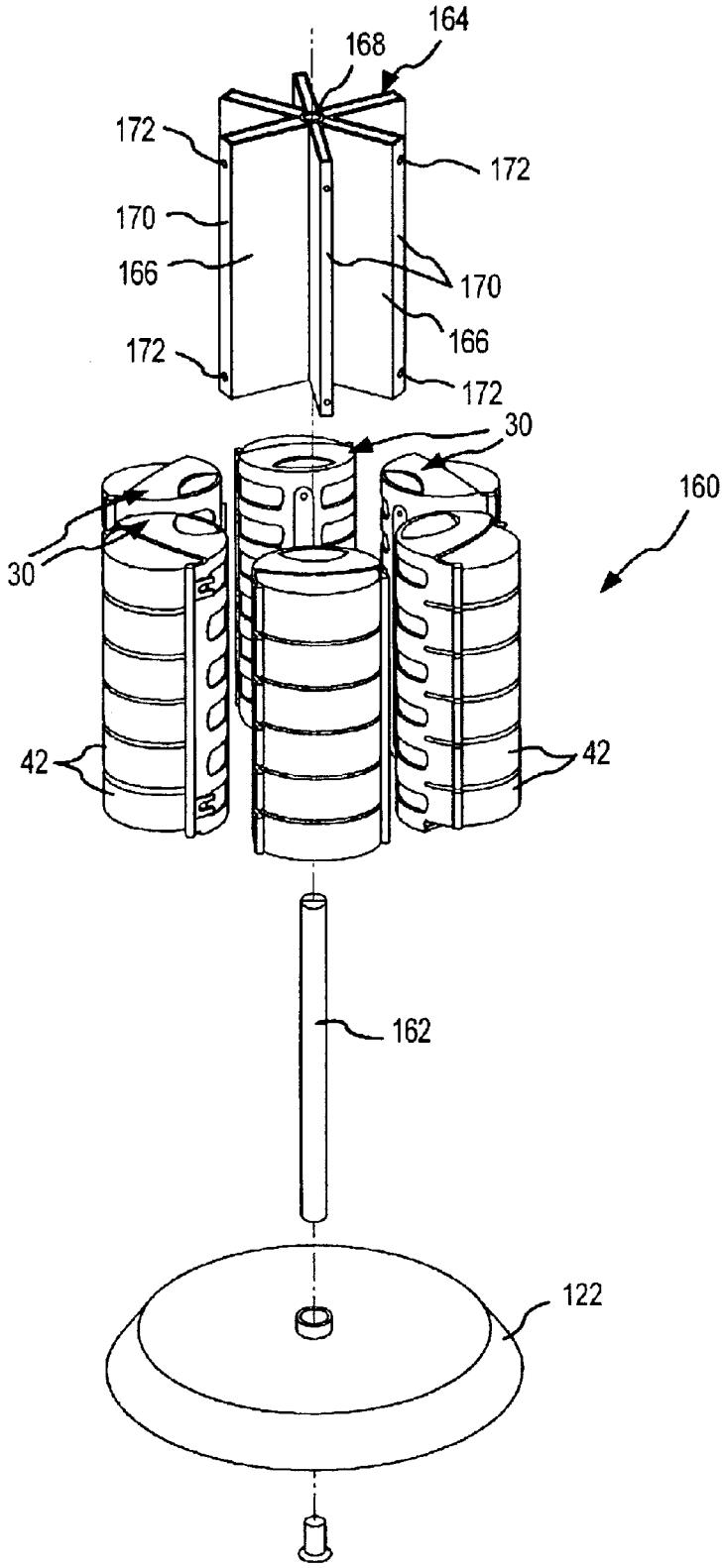
FIG. 23 is a partial cross-sectional view taken substantially in the plane of line 19—19 of FIG. 17.

Another type 160 of a carousel formed from a multiplicity of the clip trays 30 is shown in FIG. 23. In the carousel 160, the base member 122 has rigidly attached to it a vertically standing center pole 162. A star shaped member 164 includes a plurality of walls 166 that extend radially outward from the center of the star shaped member 164. A central opening 168 extends through the center of the star shaped member 164, and the central opening 168 receives the pole 162 within it. The star shaped member 164 is supported for rotation relative to the pole 162 and the stationary base member 122.

A radially outer end 170 of each wall 166 of the star shaped member 164 has a flat surface. Holes 172 are formed in the outer ends 170 at locations adapted to align with the attachment holes 76 (FIGS. 1–3 and 8) in each clip tray 30. Each clip tray 30 is thereby attached to the outer ends 170 of each wall 166 of the star shaped member 160. The attachment is made by screws in a manner analogous to that shown in FIG. 9, or by double backed tape or by a hook and loop faster in a manner analogous to that shown in FIG. 10.

In all of the embodiments of the carousels 120, 140, 150 and 160 shown in FIGS. 20–23, the spacing of the clip trays 30 around the circumference of the assembled carousel allows adequate space between adjacent clip trays for fingers to extend behind the back walls 32 to apply a finger pressure through the openings 64 (FIGS. 1–3) to remove the cylindrical containers 42 from the receptacles 40 upon deflection of the release tabs 50, as shown in FIG. 6.

Other configurations for multiple clip trays arranged as point of purchase dispensers or as other organizers may be assembled. In each circumstance however, or when an individual clip tray 30 is used by itself, all of the individual containers 42 retained by the clip tray can be individually presented, displayed, accessed, organized, retained, released and dispensed without moving all of the other cylindrical containers, without disturbing the organization of the other individual cylindrical containers 42, and without inadvertently releasing an unintended container from its receptacle. In general, the resulting convenience of using and dispensing the cylindrical containers 42 is significantly enhanced by using the clip trays 30, compared to the previously known forms of devices for organizing and dispensing cylindrical containers. Many other advantages and improvements of the clip tray 30 will be apparent upon gaining a full understanding of the present invention.

Presently preferred embodiments of the present invention and many of its improvements have been described above with a degree of particularity This description is by way of preferred examples of implementing the invention, and this description is not necessarily intended to limit the scope of the invention. The scope of the invention is defined by the following claims.

The invention claimed is:

1. A clip tray for presenting, retaining and releasing a disk-like cylindrical container, the cylindrical container having a cylindrical sidewall and two generally planar end walls, said clip tray comprising:

a partial cylindrical back wall having a first portion and a second adjoining portion extending from the first portion, the second portion moveable between first and second positions relative to the first portion, the first portion adapted to extend circumferentially less than 180 degrees around the cylindrical sidewall of the container and to contact and adjoin the cylindrical sidewall of the container at positions spaced circumferentially less than 180 degrees around the cylindrical sidewall of the container, the first and second portions of the back wall adapted to contact and adjoin the cylindrical sidewall of the container at cumulative positions greater than 180 degrees around the cylindrical sidewall of the container when the second portion is in the first position, and the second portion moveable in the second position outward from the first position to permit less than 180 degrees of contact by the first portion with the cylindrical sidewall of the container;

first and second dividers connected to the first portion of the back wall and adapted to contact the two opposite generally planar end walls of the container respectively, the first and second dividers and the first portion of the back wall between the dividers defining a receptacle for the container, each divider extending along the first portion of the back wall and terminating at a terminal end approximately where the first and second portions of the back wall adjoin one another; and slots formed in the back wall generally in alignment with the dividers to extend the second portion of the back wall outward from the receptacle at the terminal ends of the dividers and to separate the second portion from adjacent portions of the back wall except where the first and second portions of the back wall adjoin one another.

2. A clip tray as defined in claim 1, wherein:

the second portion of the back wall is an integral extension of the first portion of the back wall.

3. A clip tray as defined in claim 1, wherein:

the second portion of the back wall is resiliently deflectable relative to the first portion of the back wall.

4. A clip tray as defined in claim 3, further comprising:

a release arm connected to and extending from the second portion of the back wall to a location adjacent the first portion of the back wall, the release arm moving into the receptacle within the first portion of the back wall upon movement of the second portion to the second position.

5. A clip tray as defined in claim 4, further comprising:

a release tab connected to move the second portion of the back wall to the second position; and wherein:

the release arm moves into the receptacle within the first portion of the back wall upon the release tab moving the second portion of the back wall into the second position.

6. A clip tray as defined in claim 4, wherein:

the release arm is an integral extension of the second portion of the back wall.

7. A clip tray as defined in claim 6, wherein:

the release arm comprises a cutout portion of the first portion of the back wall.

8. A clip tray as defined in claim 1, wherein:

the divider extends substantially along the full circumferential extent of the first portion of the back wall.

9. A clip tray as defined in claim 1, wherein:

the dividers are formed integrally with the first portion of the back wall.

10. A clip tray as defined in claim 1, wherein:

the first portion of the back wall defines an opening through which to apply force to the cylindrical sidewall of the container to remove the container from the receptacle.

11. A clip tray as defined in claim 1, wherein:

the first portion of the back wall defines an opening through which light illuminates the container within the receptacle.

12. A clip tray as defined in claim 1, wherein:

each divider includes a pair of oppositely circumferentially extending ribs which terminate at the opposite terminal ends of the divider.

13. A clip tray as defined in claim 12, wherein:

each slot extends circumferentially along the second portion of the back wall and terminates at the terminal end of one rib.

14. A clip tray as defined in claim 13, wherein:

the second portion includes a release arm integrally connected to the back wall and extending to a location within the receptacle adjacent the first portion of the back wall, the release arm moving into the receptacle and adapted to contact the cylindrical sidewall to urge the container out of the receptacle upon movement of the second portion of the back wall to the second position, and wherein:

the second portion and the release arm resiliently pivot at a fulcrum location of the back wall adjacent to each slot at the terminal end of each rib.

15. A clip tray as defined in claim 12, wherein:

each divider includes a central protrusion which extends outward from the back wall; and each rib portion extends from the central protrusion in an opposite circumferential direction from the other rib portion.

16. A clip tray as defined in claim 1, further comprising:

a plurality of the receptacles oriented in a generally parallel and axially spaced relationship relative to the partial cylindrical sidewall of each receptacle; and the first portions of the back walls of all of the plurality of receptacles are formed by portions of a single larger partial cylindrical back wall which is common to all of the back walls of all of the receptacles.

17. A clip tray as defined in claim 16, in combination with a fastener for connecting the clip tray to a support surface, the fastener comprising:

first and second fastening portions for interconnecting with one another, one of the fastening portions connected to an exterior of the common partial cylindrical sidewall, and the other one of fastening portions adapted to be connected to the support surface.

18. A clip tray as defined in claim 17, wherein:

the fastener comprises tape having fastening portions formed by adhesive sides, one of the adhesive sides connected to the common partial cylindrical sidewall and the other adhesive side adapted to connect to a support.

19. A clip tray as defined in claim 16, further comprising:

an attachment hole formed in the common partial cylindrical sidewall through which a fastener may be extended to connect the clip tray to a support.

20. A clip tray as defined in claim 19, wherein:

the attachment hole has the configuration of a key slot.

21. A clip tray as defined in claim 19, in combination with a carousel comprising:

a bottom plate member having an attachment member connected to the bottom plate member; and a plurality of the clip trays connected to and extending from the bottom plate member; and wherein:

each clip tray is connected to the attachment member by a fastener extending through the attachment hole.

22. A clip tray as defined in claim 21, wherein:

the attachment member comprises a plurality of flanges extending from the bottom plate member.

23. A clip tray as defined in claim 21, wherein:

the attachment member comprises a collar extending from the bottom plate member.

24. A clip tray as defined in claim 16, wherein:

a single divider forms a portion of each of a pair of axially adjacent receptacles; and the dividers are formed integrally with the common partial cylindrical back wall.

25. A clip tray as defined in claim 16, wherein:

the first and second portions of the back walls of all of the plurality of receptacles are formed by the common partial cylindrical back wall; and a plurality of the slots are formed in the common partial cylindrical back wall to define the second portions for each receptacle from the common partial cylindrical back wall.

26. A clip tray as defined in claim 25, wherein:

each divider includes a pair of ribs extending circumferentially in opposite directions and terminating at opposite terminal ends of each divider; and the terminal ends of the ribs are adjacent to innermost portions of the slots.

27. A clip tray as defined in claim 16, further comprising:

end walls attached to the common partial cylindrical back wall adjacent to the first portions at axially opposite ends of the common partial cylindrical back wall.

28. A cup tray as defined in claim 27, in combination with a carousel comprising:

a bottom plate member having an attachment member connected to the bottom plate member; and wherein:

the attachment member comprises a wall member; and one clip tray is connected to one wall member.

29. A clip tray as defined in claim 27, in combination with a carousel comprising:

a bottom plate member having an attachment member connected to the bottom plate member, the attachment member including a plurality of wall members which extend in a star shaped configuration; and the common partial cylindrical back wall of each clip tray is connected to a wall member.

30. A clip tray as defined in claim 27, further comprising:

an edge extending axially along the first portions of the common partial cylindrical back wall; and a retention tab connected to the axially extending edge, the retention tab including an opening for receiving a fastener.

31. A clip tray as defined in claim 30, wherein:

the retention tab is bifurcated by a slot which defines two arm portions, the arm portions each include detents which extend into the slot toward one another, the arm portions deflecting apart upon moving a fastener through the slot and into the opening, the arm portions returning to an original position after the fastener has passed beyond the detents.

32. A clip tray as defined in claim 27, for use with an attachment bracket to position and orient the clip tray, wherein:

each end wall has a predetermined shape; and each attachment bracket includes a portion defining a predetermined shape to mate with the predetermined shape of each end wall.

33. A clip tray as defined in claim 27, in combination with a carousel comprising:

a bottom plate member having a plurality of complementary shaped portions each defining a predetermined shape to complement with the predetermined shape of each end wall; and a plurality of the clip trays extending from the bottom plate member with one end wall of each clip tray connecting with one of the complementary shaped portions of the bottom plate member.

34. A clip tray as defined in claim 27, further comprising:

support feet connected to the common partial cylindrical back wall opposite from the receptacles, the support feet adapted to contact a horizontal support and support the common partial cylindrical back wall above the horizontal support.

35. A clip tray as defined in claim 34, further comprising:

a release tab connected to each second portion of the back wall, the release tab including a push lever connected to the second portion of the back wall upon which to push to move the second portion to the second position.

36. A clip tray as defined in claim 34, further comprising:

a release arm connected to second portion of the back wall and extending from the second portion to a location within the receptacle adjacent the first portion of the back wall, the release arm adapted to move into contact with the sidewall of the cylindrical container at a location adjacent to the first portion of the back wall to urge the cylindrical container out of the receptacle upon the second portion moving to the second position.

37. A method of individually retaining each of a plurality of disk-like cylindrical containers within a tray-like configuration which has plurality of parallel oriented adjoining receptacles separated from one another by a divider and also individually releasing each cylindrical container from its receptacle without releasing or otherwise influencing the retention of the cylindrical containers in the adjoining receptacles, each cylindrical container having a cylindrical sidewall connected by two generally planar end walls, the method comprising:

contacting the cylindrical sidewall of each container with fixed contacts of each receptacle at positions spaced circumferentially less than 180 degrees around the cylindrical sidewall of the container;

contacting the cylindrical sidewall of the container with a movable contact of each receptacle, the movable contact adapted to contact the cylindrical sidewall of the container at a position which cumulatively with the fixed contacts extends the circumferential contact with the cylindrical sidewall to greater than 180 degrees when the movable contact is in a first position and to less than 180 degrees when the movable contact is in a second position;

moving one movable contact of one receptacle to the second position to release the cylindrical container from the one receptacle without moving the movable contacts of receptacles adjoining the one receptacle from their first positions; and moving each movable contact to the first position to retain the cylindrical container in each receptacle.

38. A method as defined in claim 37, further comprising:

contacting the cylindrical sidewall of the container with a release arm connected to the second portion of the back wall to apply force on cylindrical sidewall to urge the cylindrical container out of the receptacle upon movement of the movable contact to the second position.

39. A method as defined in claim 37, further comprising:

urging the cylindrical container out of the receptacle after moving the movable contact to the second position.

40. A method as defined in claim 39, A further comprising:

urging the cylindrical container out of the receptacle while simultaneously moving the movable contact to the second position.

41. A method as defined in claim 37, further comprising:

attaching a plurality of the tray-like configurations to a carousel.

42. A method as defined in claim 37, further comprising:

self-supporting the tray-like configuration on a horizontal support surface by contacting support feet of the tray-like configuration on the horizontal support surface.

43. A method as defined in claim 37, further comprising:

attaching the tray-like configuration to a support surface.

44. A method as defined in claim 37, further comprising:

contacting the cylindrical sidewall of the container with a partial cylindrical back wall of the receptacle;

locating the fixed contacts on a first portion of the back wall circumferentially less than 180 degrees around the cylindrical sidewall of the container; and locating the movable contact on a second portion of the back wall which adjoins the first portion of the back wall and which when accumulated with the first portion extends the circumferential contact to greater than 180 degrees around the cylindrical sidewall of the container.

45. A method as defined in claim 44, further comprising:

attaching the tray-like configuration to a support surface at the first portions of the back walls of at least some of the receptacles.

46. A method as defined in claim 44, further comprising:

directing light onto the container retained within the receptacle through an opening formed in the first portion of the back wall.

47. A method as defined in claim 44, wherein the receptacle is defined by a pair of axially spaced apart dividers, each divider extends circumferentially along the first portion of the back wall, each divider integrally extends from the first portion of the back wall, each divider terminates at a terminal end at a location on the back wall where the first and second portions of the back wall adjoin one another, and a slot is formed into the back wall generally in alignment with each divider to define the second portion of the back wall as extending outward from the receptacle and to separate the second portion from adjoining portions of the back wall except where the first and second portions adjoin one another.

48. A method as defined in claim 47, further comprising:

guiding the cylindrical containers along the dividers upon inserting the cylindrical containers into the receptacles and when removing the cylindrical containers from the receptacles.

49. A method as defined in claim 44, further comprising:

resiliently deflecting the second portion of the back wall relative to the first portion of the back wall to move the movable contact into the second position.

50. A method as defined in claim 44, further comprising:

applying pressure to the container through an opening formed in the first portion of the back wall to remove the cylindrical container from the receptacle.

51. A method as defined in claim 50, further comprising:

applying the pressure through the opening while simultaneously resiliently deflecting the second portion of the back wall to move the movable contact to the second position.

52. A clip tray for presenting, retaining and releasing a disk-like cylindrical container, the cylindrical container having a cylindrical sidewall and two opposite generally planar end walls, said clip tray comprising:

a partial cylindrical back wall having a first portion and a second portion adjoining the first portion, the first portion adapted to extend circumferentially less than 180 degrees around the cylindrical sidewall of the container and adopted to contact and adjoin the cylindrical sidewall of the container at positions spaced circumferentially less than 180 degrees around the cylindrical sidewall of the container, the second portion extending from the first portion and moveable into first and second positions relative to the first portion, the first and second portions adapted to contact and adjoin the cylindrical sidewall of the container at cumulative positions greater than 180 degrees around the cylindrical sidewall of the container when the first portion is in the first position, the second portion moveable in the second position outward from the first position to permit less than 180 degrees of contact with the cylindrical sidewall; and first and second dividers connected to the back wall and adapted to contact the two opposite generally planar end walls of the container respectively, the first and second dividers and the back wall between the dividers defining a receptacle for the container; and the first portion of the back wall defining an opening between the dividers through which force may be applied to remove the container from the receptacle.

53. A clip tray as defined in claim 52, further comprising:

support feet connected to the common partial cylindrical back wall on an opposite side of the common partial cylindrical back wall from the receptacles, the support feet adapted to contact a horizontal support and support the common partial cylindrical back wall above the horizontal support.

54. A clip tray as defined in claim 53, further comprising:

a release arm connected to second portion of the back wall and extending from the second portion to a location within the receptacle adjacent the first portion of the back wall, the release arm adapted to move into contact with the sidewall of the cylindrical container at a location adjacent to the first portion of the back wall to urge the cylindrical container out of the receptacle upon the second portion of the back wall moving to the second position.

55. A clip tray as defined in claim 53, further comprising:

a push lever connected to the second portion of the back wall by which to move the second portion of the back wall to the second position.

56. A clip tray as defined in claim 52, wherein:

the first and second portions of the back walls of all of the plurality of receptacles are formed by the common partial cylindrical back wall; and a plurality of the slots are formed in the common partial cylindrical back wall to define the second portions for each receptacle from the common partial cylindrical back wall.

57. A clip tray as defined in claim 56, wherein:

each divider includes a pair of ribs extending circumferentially in opposite directions and terminating at opposite terminal ends of each divider; and the terminal ends of the ribs are adjacent to innermost portions of the slots.

58. A clip tray as defined in claim 52, wherein:

the second portion of the back wall is an integral extension of the first portion of the back wall.

59. A clip tray as defined in claim 52, wherein:

the second portion of the back wall is resiliently deflectable relative to the first portion of the back wall.

60. A clip tray as defined in claim 52, wherein:

the divider extends substantially along the full circumferential extent of the first portion of the back wall.

61. A clip tray as defined in claim 52, wherein:

the dividers are formed integrally with the first portion of the back wall.

62. A clip tray as defined in claim 52, wherein:

each divider includes a pair of oppositely circumferentially extending ribs which terminate at the opposite terminal ends of the divider.

63. A clip tray as defined in claim 62, further comprising:

slots formed circumferentially in the back wall generally in alignment with the terminal ends of the dividers to extend the second portion of the back wall outward from the receptacle at the terminal ends of the dividers and to separate the second portion from adjacent portions of the back wall except where the first and second portions of the back wall adjoin one another.

64. A clip tray for presenting, retaining and releasing a disk-like cylindrical container, the cylindrical container having a cylindrical sidewall and two opposite generally planar end walls, said clip tray comprising:

a partial cylindrical back wall having a first portion and a second portion adjoining the first portion, the first portion adapted to extend circumferentially less than 180 degrees around the cylindrical sidewall of the container and adopted to contact and adjoin the cylindrical sidewall of the container at positions spaced circumferentially less than 180 degrees around the cylindrical sidewall of the container, the second portion extending from the first portion and moveable into first and second positions relative to the first portion, the first and second portions adapted to contact and adjoin the cylindrical sidewall of the container at cumulative positions greater than 180 degrees around the cylindrical sidewall of the container when the first portion is in the first position, the second portion moveable in the second position outward from the first position to permit less than 180 degrees of contact with the cylindrical sidewall; and first and second dividers connected to the back wall and adapted to contact the two opposite generally planar end walls of the container respectively, the first and second dividers and the back wall between the dividers defining a receptacle for the container; and the first portion of the back wall defining an opening between the dividers through which light may illuminate the container.

65. A clip tray as defined in claim 64, further comprising:

support feet connected to the common partial cylindrical back wall on an opposite side of the common partial cylindrical back wall from the receptacles, the support feet adapted to contact a horizontal support and support the common partial cylindrical back wall above the horizontal support.

66. A clip tray as defined in claim 65, further comprising:

a release arm connected to second portion of the back wall and extending from the second portion to a location within the receptacle adjacent the first portion of the back wall, the release arm adapted to move into contact with the sidewall of the cylindrical container at a location adjacent to the first portion of the back wall to urge the cylindrical container out of the receptacle upon the second portion of the back wall moving to the second position.

67. A clip tray as defined in claim 65, further comprising:

a push lever connected to the second portion of the back wall by which to move the second portion of the back wall to the second position.

68. A clip tray as defined in claim 64, wherein:

the first and second portions of the back walls of all of the plurality of receptacles are formed by the common partial cylindrical back wall; and a plurality of the slots are formed in the common partial cylindrical back wall to define the second portions for each receptacle from the common partial cylindrical back wall.

69. A clip tray as defined in claim 68, wherein:

each divider includes a pair of ribs extending circumferentially in opposite directions and terminating at opposite terminal ends of each divider; and the terminal ends of the ribs are adjacent to innermost portions of the slots.

70. A clip tray as defined in claim 64, wherein:

each divider includes a pair of oppositely circumferentially extending ribs which terminate at the opposite terminal ends of the divider.

71. A clip tray as defined in claim 70, further comprising:

slots formed circumferentially in the back wall generally in alignment with the terminal ends of the dividers to extend the second portion of the back wall outward from the receptacle at the terminal ends of the dividers and to separate the second portion from adjacent portions of the back wall except where the first and second portions of the back wall adjoin one another.

72. A clip tray as defined in claim 64, wherein:

the second portion of the back wall is an integral extension of the first portion of the back wall.

73. A clip tray as defined in claim 64, wherein:

the second portion of the back wall is resiliently deflectable relative to the first portion of the back wall.

74. A clip tray as defined in claim 64, wherein:

the divider extends substantially along the full circumferential extent of the first portion of the back wall.

75. A clip tray as defined in claim 64, wherein:

the dividers are formed integrally with the first portion of the back wall.

* * * * *